US008464525B2

(12) United States Patent
Springett et al.

(10) Patent No.: US 8,464,525 B2
(45) Date of Patent: Jun. 18, 2013

(54) SUBSEA POWER FLUID RECOVERY SYSTEMS

(75) Inventors: Frank Benjamin Springett, Spring, TX (US); Eric Trevor Ensley, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 1334 days.

(21) Appl. No.: 12/012,001

(22) Filed: Jan. 30, 2008

(65) Prior Publication Data

US 2008/0267786 A1 Oct. 30, 2008

Related U.S. Application Data

(60) Provisional application No. 60/900,047, filed on Feb. 7, 2007.

(51) Int. Cl.
*F01L 15/16* (2006.01)
*F01L 31/02* (2006.01)
*E21B 7/12* (2006.01)

(52) U.S. Cl.
USPC ..... 60/398; 91/193; 91/195; 91/346; 92/52; 166/352

(58) Field of Classification Search
USPC .... 60/398; 91/193, 195, 346; 92/52; 166/352
See application file for complete search history.

(56) References Cited

U.S. PATENT DOCUMENTS 1,061,970 A * 5/1913 Augur ..... 91/193
2,193,736 A 3/1940 Onions
2,393,524 A 1/1946 Fant, Jr.
2,411,438 A 11/1946 Lane
2,456,832 A 12/1948 Lane
2,554,381 A 5/1951 Patterson, Jr.
2,747,370 A 5/1956 Traut
2,890,658 A * 6/1959 Hjarpe ..... 91/195
3,044,481 A 7/1962 Regan
3,163,985 A 1/1965 Bouyoucos
3,205,969 A 9/1965 Clark
3,436,914 A 4/1969 Rosfelder (Continued)

FOREIGN PATENT DOCUMENTS

GB 2 345 504 7/2000

*Primary Examiner* — F. Daniel Lopez
(74) *Attorney, Agent, or Firm* — JL Salazar Law Firm

(57) ABSTRACT

Systems and methods for recovering power fluid used to power a device under water and for pumping the recovered power fluid to a fluid container above a surface of the water, the method in certain aspects including: flowing fluid from a subsurface apparatus to a subsurface recovery system, the fluid initially provided to the subsurface apparatus to power the subsurface apparatus; and the subsurface recovery system including a pump system for selectively pumping recovered power fluid to a fluid container above a surface of the water, the pump system having at least one pump and, in some aspects, a first pump, a second pump, and a valve system; the valve system controlling the first pump and the second pump to allow only one pump of the first pump and the second pump to pump recovered power fluid to the fluid container above the surface of the water; and pumping recovered power fluid to the fluid container with only one pump at a time. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

25 Claims, 22 Drawing Sheets

U.S. PATENT DOCUMENTS

| | | | | |
|---|---|---|---|---|
| 3,653,635 | A | 4/1972 | Bates, Jr. et al. | |
| 3,669,151 | A | 6/1972 | Fleming | |
| 3,677,001 | A | 7/1972 | Childers et al. | |
| 3,750,404 | A | 8/1973 | Murman et al. | |
| 3,856,048 | A | 12/1974 | Gratzmuller | |
| 3,906,726 | A | 9/1975 | Jameson | |
| 3,912,227 | A | 10/1975 | Meeker et al. | |
| 3,918,498 | A | 11/1975 | Schneider | |
| 3,921,500 | A | 11/1975 | Silcox | |
| 3,987,708 | A | 10/1976 | Uhrich | |
| 4,095,421 | A | 6/1978 | Silcox | |
| 4,185,652 | A | 1/1980 | Zintz et al. | |
| 4,187,682 | A | 2/1980 | Shen | |
| 4,204,461 | A | 5/1980 | Gratzmuller | |
| 4,205,594 | A | 6/1980 | Burke | |
| 4,234,295 | A | 11/1980 | Jensen | |
| 4,249,452 | A | 2/1981 | Brown | |
| 4,278,403 | A | 7/1981 | Shafer | |
| 4,294,284 | A | 10/1981 | Herd | |
| 4,347,049 | A | 8/1982 | Anderson | |
| 4,349,041 | A | 9/1982 | Bates | |
| 4,414,808 | A | 11/1983 | Benson | |
| 4,475,710 | A | 10/1984 | Leupers | |
| 4,646,517 | A | 3/1987 | Wright | |
| 4,649,704 | A | 3/1987 | Marsh | |
| 4,777,800 | A | 10/1988 | Hay, II | |
| 4,923,008 | A | 5/1990 | Wachowicz et al. | |
| 4,955,195 | A | 9/1990 | Jones et al. | |
| 5,287,879 | A | 2/1994 | Leggett et al. | |
| 5,474,304 | A | 12/1995 | Daiber et al. | |
| 6,192,680 | B1 | 2/2001 | Brugman et al. | |
| 6,202,753 | B1 | 3/2001 | Baugh | |
| 6,266,959 | B1 | 7/2001 | Markwart | |
| 6,415,877 | B1 * | 7/2002 | Fincher et al. | 175/5 |
| 6,418,970 | B1 | 7/2002 | Deul | |
| 6,834,680 | B2 | 12/2004 | Baugh | |
| 7,108,006 | B2 | 9/2006 | Armstrong | |
| 7,131,496 | B2 | 11/2006 | Williams et al. | |
| 2003/0037544 | A1 | 2/2003 | Armstrong | |
| 2004/0108008 | A1 | 6/2004 | Baugh | |

* cited by examiner

FIG. 1
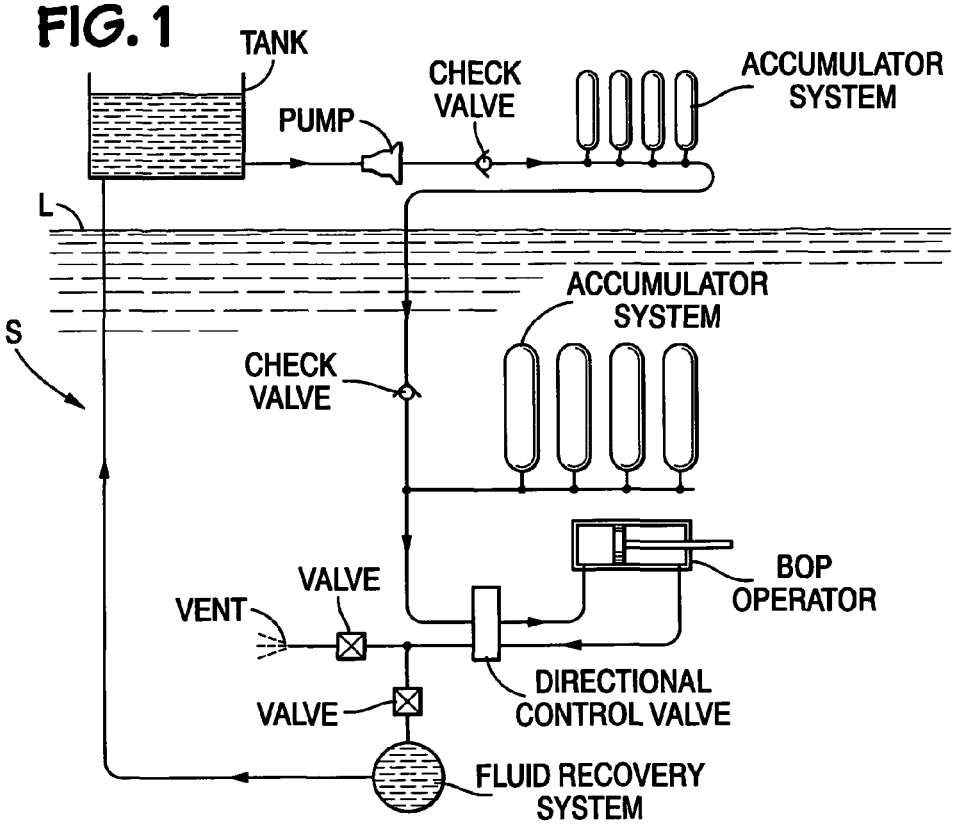
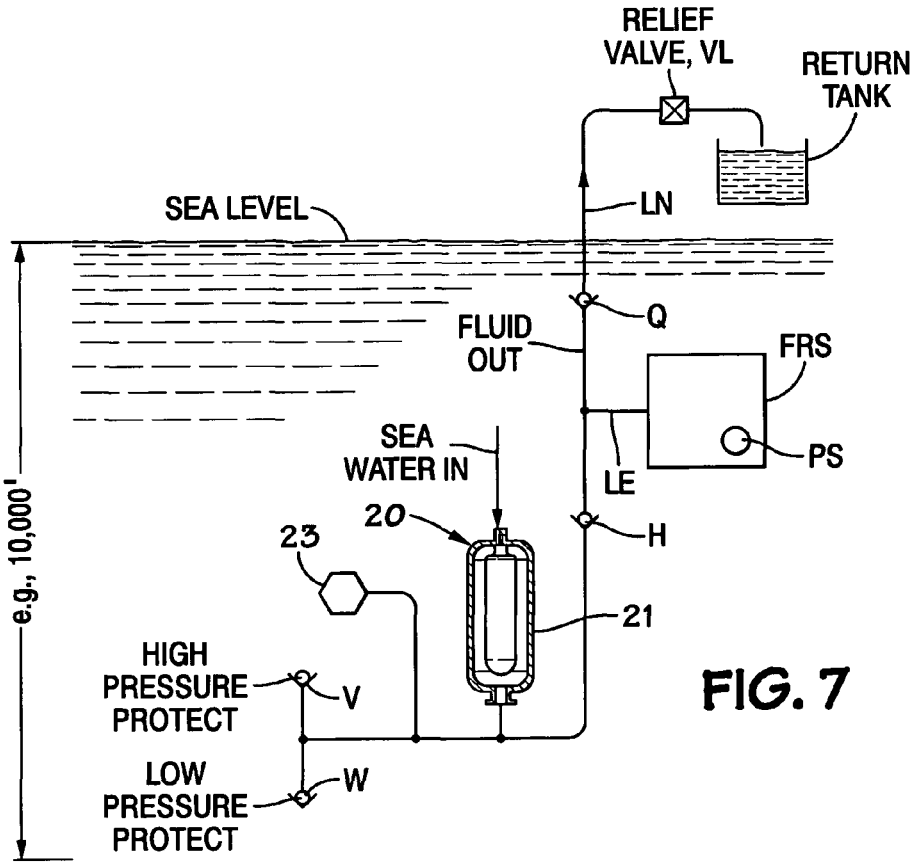
FIG. 7

FIG. 2B
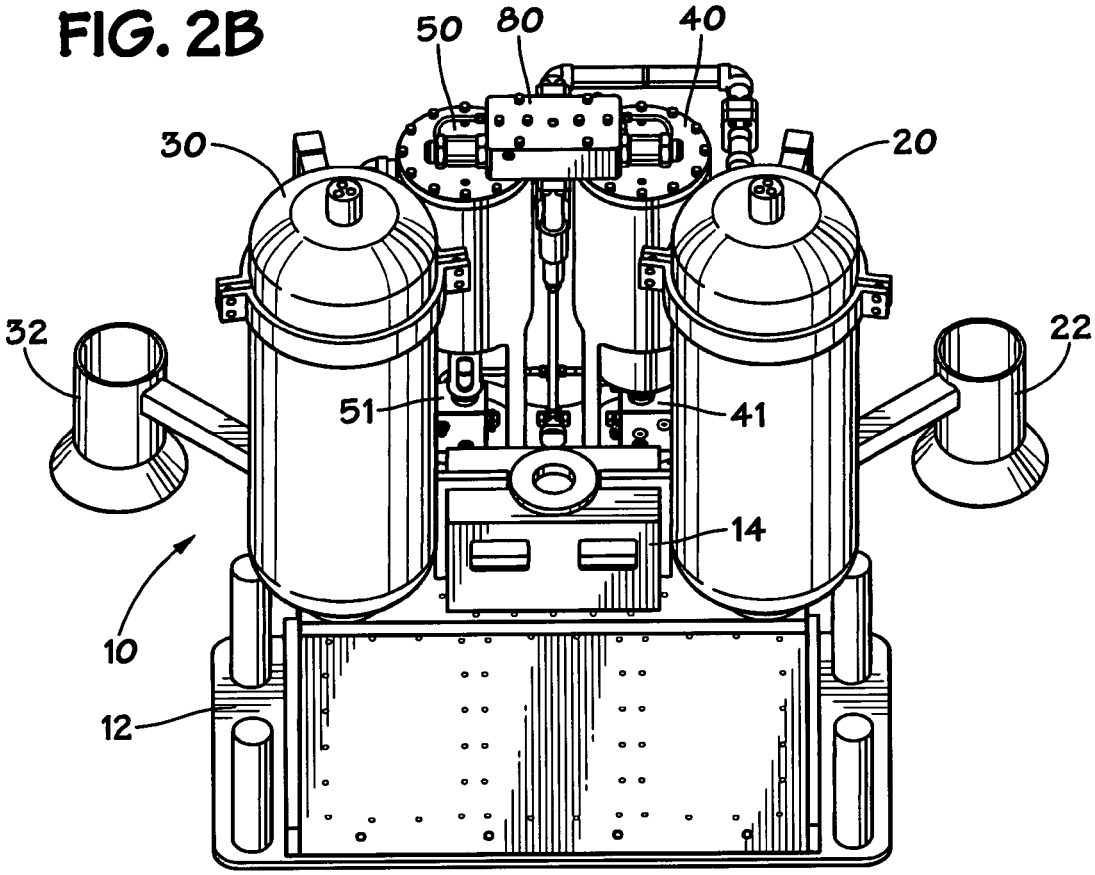
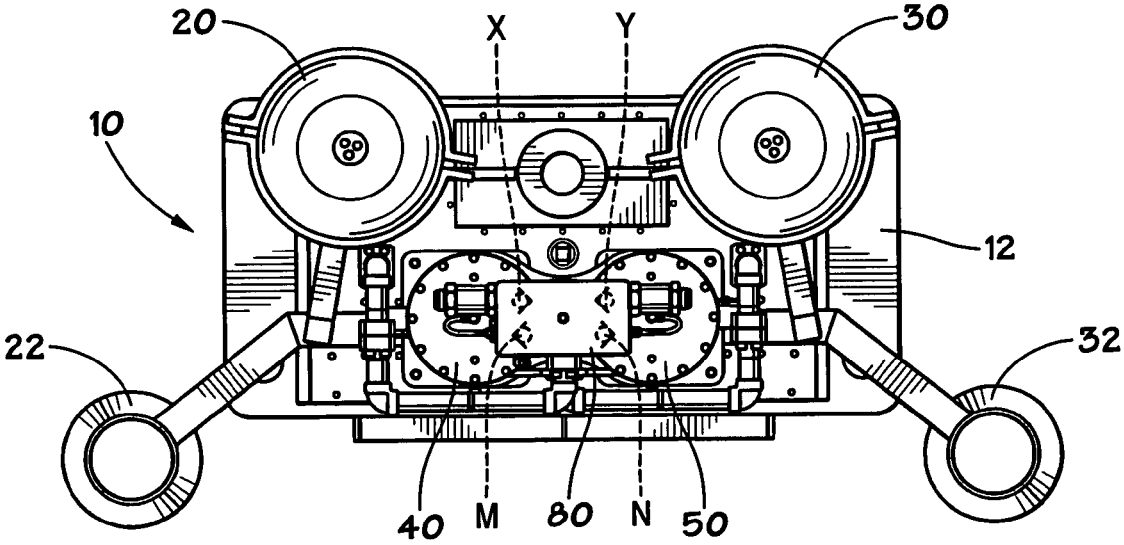
FIG. 2C

SUBSEA POWER FLUID RECOVERY SYSTEMS

CROSS-REFERENCE TO RELATED APPLICATION

This application and the present invention claim under U.S. Patent Law, including under 35 U.S.C. §120, the benefit of and priority from U.S. Application Ser. No. 60/900,047 filed Feb. 7, 2007 and Ser. No. 11/594,012 filed Nov. 7, 2006, both co-owned with the present invention and incorporated fully herein for all purposes.

BACKGROUND OF THE INVENTION

1. Field of the Invention

The present invention is directed to underwater power fluid systems and recovery of expended power fluid from such systems.

2. Description of Related Art

Deepwater power fluid systems provide pressurized working fluid for the control and operation of equipment, e.g. for blowout preventer operators; gate valves for the control of flow of oil or gas to the surface or to other subsea locations; hydraulically actuated connectors; and similar devices. The fluid to be pressurized is typically an oil based product or a water based product with added lubricity and corrosion protection, e.g., but not limited to hydraulic fluid. In certain prior art systems, once the power fluid has done its job in the operation of a device, it is exhausted into the water environment around the device.

U.S. Pat. Nos. 7,108,006; 6,202,753; 4,777,800; 4,649,704; and 3,677,001 are illustrative of various prior art subsea power fluid systems and are mentioned here not by way of limitation nor as exhaustive of the available prior art; and all said patents are incorporated fully herein for all purposes.

There has long been a need, recognized by the present inventor, for an effective method and system for preventing exhausted power fluids from polluting a body of water.

BRIEF SUMMARY OF THE INVENTION

The present invention, in certain aspects, discloses a fluid recovery system in which power fluid used by and exhausted from a subsea apparatus, e.g., but not limited to a blowout preventer operator, is recovered and pumped from beneath the water back to the surface.

In certain aspects, such a system has reserve capacity apparatus for receiving the exhausted power fluid so that a pump (or pumps) pumping the fluid is not overloaded or rendered inefficient.

In certain aspects, in such a system a negative internal pressure is maintained on a pump system (with a pump or pumps), e.g. with a line leading to the pump system maintained at a pressure lower than a pressure in an input line to a system providing reserve capacity so that the reserve capacity system remains evacuated of all power fluid and filled or substantially filled with water (e.g. seawater) exterior to the system. This insures that, in certain aspects, all power fluid to be pumped to the surface is indeed pumped to the surface. Optionally this is achievable using a switch that turns the pump(s) off when the reserve capacity system is empty of pushing fluid.

In certain aspects, a pumping system useful in embodiments of the present invention has both high pressure and low pressure protection, e.g. one or more relief valves (e.g. "cracking" check valves) so that the line leading to a pump system is not at too high a pressure, i.e., to protect a pump system enclosure or housing from undesirable pressures (either too high or too low).

In certain embodiments, two (or more) pumps are used to pump exhausted power fluid to the surface. The pumps' action is timed so that, when one pump is pumping fluid, the other pump is in the process of receiving fluid to be pumped. Thus fluid can be continuously pumped without the downtime associated with a single pump system's fluid reception by the single pump. In certain aspects, using more than one pump results in a reduced requirement for reserve capacity and/or provides a relatively constant flow rate of fluid to the surface. In certain aspects, pilot signals are provided from each pump to a valve assembly of the other pump so that only one pump at a time is pumping fluid to the surface.

In certain aspects, in system according to the present invention the pump or pumps are automatically shut off once all the exhausted fluid has been pumped to the surface.

In certain embodiments of the present invention, a pump or pumps (and, if present, a reserve capacity apparatus) are controlled by the pressure of exhausted power fluid and require no control or intervention by either subsea controls or devices or by surface controls or devices. This results in a simpler, less complex system. Upon complete evacuation of an amount of exhausted power fluid, the pump(s) stop.

In certain aspects by employing a reserve capacity apparatus in systems according to the present invention, the flow in a line or lines in which exhausted power fluid is pumped to the surface is minimized, reducing required discharge pressures and, thus reducing the power required to pump fluid to the surface. This reduced power requirement translates to a lower flow required on a pump system piston, i.e., the piston's bottom area can be reduced in size while the system still effectively pumps the fluid to the surface.

In certain aspects, in system according to the present invention, the pressure at which power fluid is supplied to an underwater device or apparatus is equalized to the pressure of the water on the underwater device or apparatus. Due to the difference in density between the power fluid and, e.g., seawater at depth, a density pressure differential occurs. Without pressure equalization, seawater could flow into the system, e.g. via check valves, resulting in the pumping of seawater with power fluid to the surface. In one aspect a relief valve in line from the pump system to the surface provides for the equalization of pressure due to the density differential.

Accordingly, the present invention includes features and advantages which are believed to enable it to advance subsea power fluid evacuation. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures.

It is, therefore, an object of at least certain preferred embodiments of the present invention to provide:

New, useful, unique, efficient, non-obvious fluid recovery systems for underwater power fluid systems;

Such systems with reserve capacity apparatus;

Such systems with high pressure and low pressure protection;

Such systems with multiple pumps (two, three, four, or more) for providing continuous pumping of recovered fluid;

Such systems with pumps with pistons having an internal compensation apparatus to facilitate piston movement and/or to assist in maintaining a negative pressure in a piston housing;

Such systems with two pumps in which only one pump at time is allowed to pump fluid to the surface;

Such systems with automatic pump shut-off; and

Such systems with power-fluid/water pressure equalization.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 1 is a schematic view of a power fluid system according to the present invention with a fluid recovery system according to the present invention.

FIG. 2B is a rear perspective view of the system of FIG. 2A.

FIG. 2C is a top view of the system of FIG. 2A.

FIG. 7 illustrates schematically a system according to the present invention for equalizing pressure between power fluid and seawater.

Figure 2A:
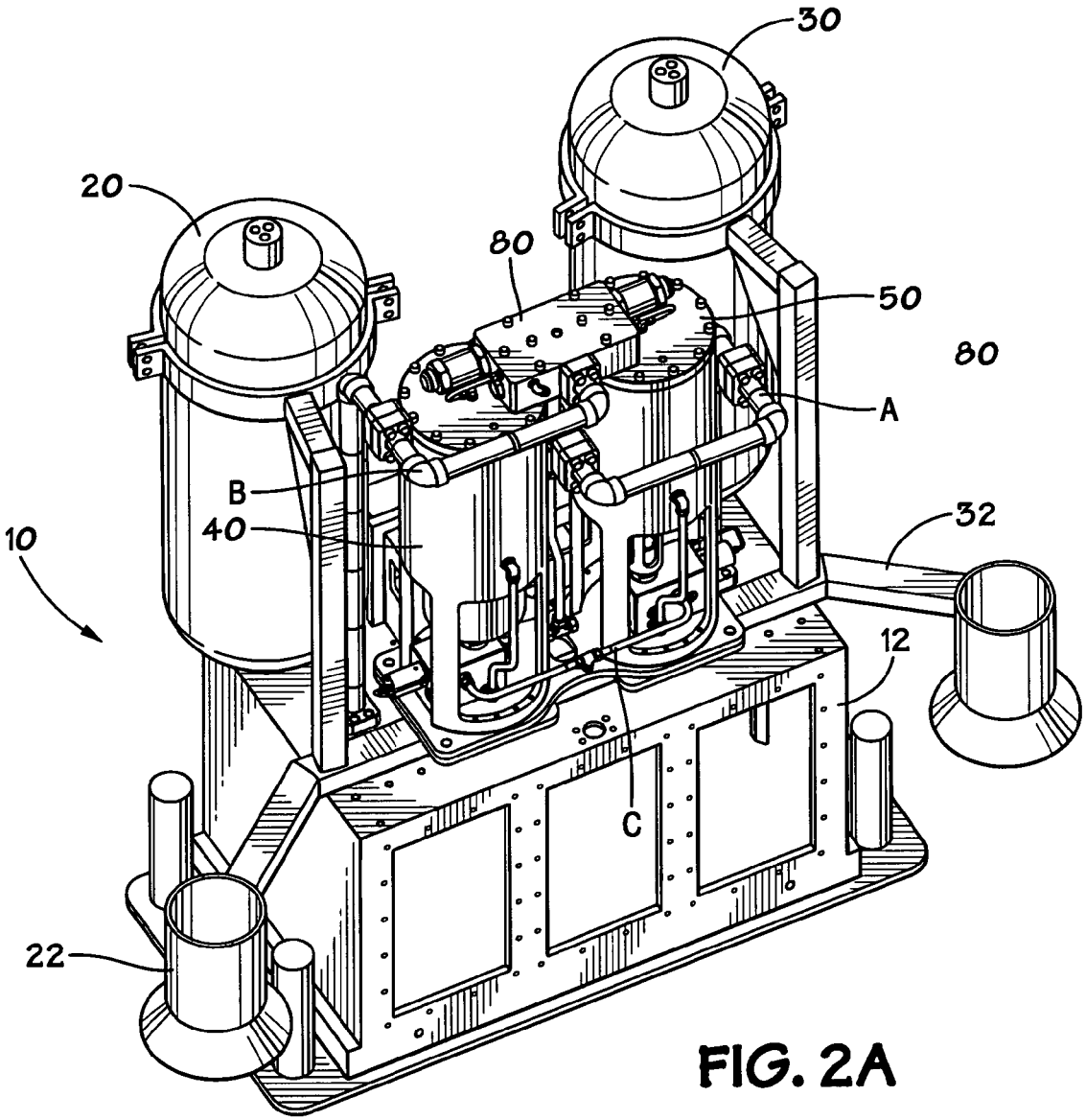
FIG. 2A is a perspective view of a system according to the present invention.

Presently preferred embodiments of the invention are shown in the above-identified figures and described in detail below. It should be understood that the appended drawings and description herein are of preferred embodiments and are not intended to limit the invention. On the contrary, the intention is to cover all modifications, equivalents and alternatives falling within the spirit and scope of the invention. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment. Accordingly, the subject or topic of each such reference is not automatically or necessarily part of, or required by, any particular description merely because of such reference.

DETAILED DESCRIPTION OF THE INVENTION

FIG. 1 shows a system S according to the present invention in which power fluid from an hydraulic power unit is provided to a subsea apparatus, e.g., but not limited to, a blowout preventer operator ("BOP OPERATOR"). Hydraulic power fluid is pumped from a reservoir ("TANK") by a pump ("PUMP") through a check valve ("CHECK VALVE") to a bank of accumulator containers at the surface ("ACCUMULATOR SYSTEM"). This fluid is then provided beneath a water level L through a check valve ("CHECK VALVE"), then optionally, to an accumulator system, e.g. with one or more depth compensated containers or bottles ("ACCUMULATOR SYSTEM") (e.g. a conventional bladder or piston accumulator or with depth compensated bottles as disclosed in U.S. application Ser. No. 11/594,012 filed Nov. 7, 2006 and co-owned with the present invention). A control valve ("DIRECTIONAL CONTROL VALVE") selectively provides the power fluid from the depth compensated accumulator containers to operate a subsea device or apparatus, e.g. the BOP operator shown. Fluid exhausted from the BOP operator either flows into the water ("VENT") or to a fluid recovery system ("FLUID RECOVERY SYSTEM") according to the present invention (any disclosed herein) with any pump or pumps disclosed herein. The power fluid is pumped to the surface, e.g. to a fluid reservoir ("TANK") or to other containers and/or conditioning systems. The accumulator system may be any suitable accumulator system including, e.g., those disclosed in U.S. application Ser. No. 11/594,012 filed on Nov. 7, 2006.

FIGS. 2A-2C show a fluid recovery system 10 according to the present invention which has two reserve bottles 20 and 30 secured to a enclosure (or pod) 12 in which valves, etc. are located and to which are secured structural members 22 and 32 (which can serve as guide tubes for guide wires that allow the system to be retrieved). Two pump systems 40 and 50, secured on the base 12, receive power fluid from the reserve bottles 20 and 30. The fluid (e.g., but not limited to, hydraulic fluid, e.g., but not limited to, from a device powered by the power fluid, e.g., but not limited to, an operator for a blowout preventer) is conveyed to the reserve bottles 20 and 30 through a line A (see also line a, FIG. 8). The system 10 has check valves X and Y (as in FIG. 8).

A typical hydraulic manifold box 14 houses hydraulic controls. Power fluid is pumped from the pump systems 40 and 50 to the surface in a return line B (see also line b, FIG. 8). Via a line C, (see also line C, FIG. 8) a constant flow of fluid under pressure is pumped from a surface system to the pump systems so that a negative internal pressure is maintained.

Figure 8:
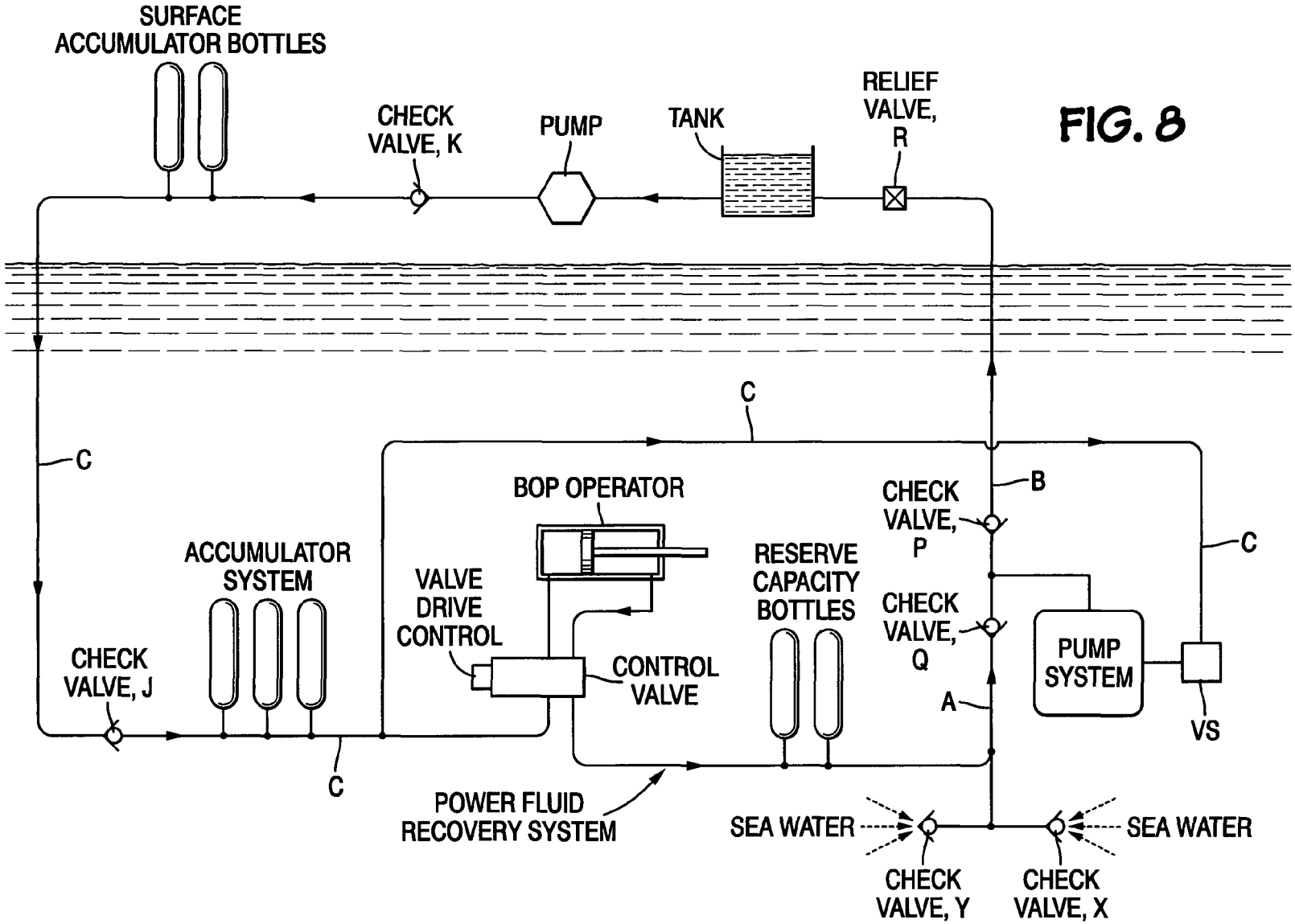
FIG. 8 is a schematic view of a system according to the present invention.

A suction/discharge manifold 80 houses the check valves X and Y and check valves M and N for the lines A and B (these check valves shown in dotted line in FIG. 2C); e.g. like the valves P and Q, FIG. 8; the valve P which may be a check valve or as shown). Each pump system 40, 50 has a corresponding valve system 41, 51 (respectively) (see, e.g. the valves V1, V2, FIG. 9A and the valve system of FIG. 5).

Figure 6A:
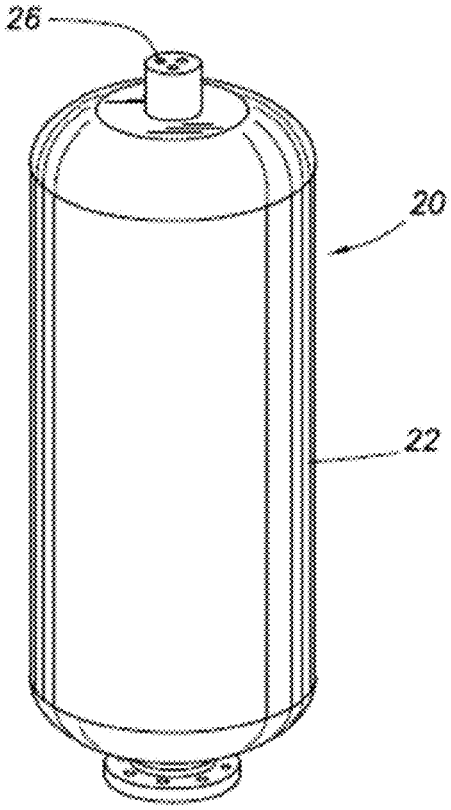
FIG. 6A is a perspective view of a reserve capacity apparatus according to the present invention.
Figure 6B:
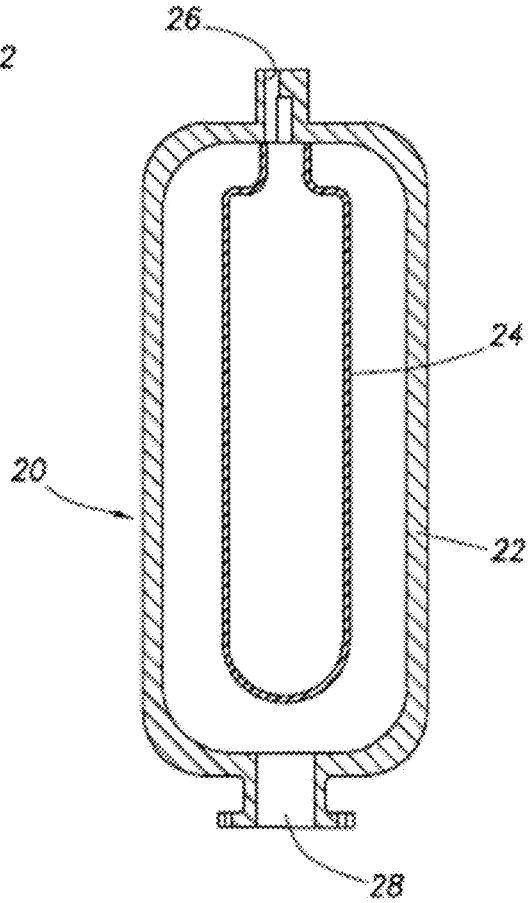
FIG. 6B is a cross-section view of the apparatus of FIG. 6A.

FIGS. 6A and 6B show one possible embodiment of the reserve bottle 20 (the bottle 30 is like the bottle 20). The bottle 20 has an outer housing 22 in which is mounted an inflatable bladder 24. Water exterior to the bottle 20 can enter the bladder 24 through a hole 26 in the housing 22. Power fluid exhausted from a subsea apparatus or device enters the housing 22 through a hole 28. As power fluid enters the housing 22 at a pressure greater than the pressure of the water exterior to the housing, water is exhausted from the bladder 24 out from the housing 22.

Alternatively, the bladder 24 is used to contain exhausted power fluid and water is introduced around the bladder 24. In certain particular embodiments, each bottle 20 and 30 can contain about 80 gallons of power fluid.

Figure 9A:
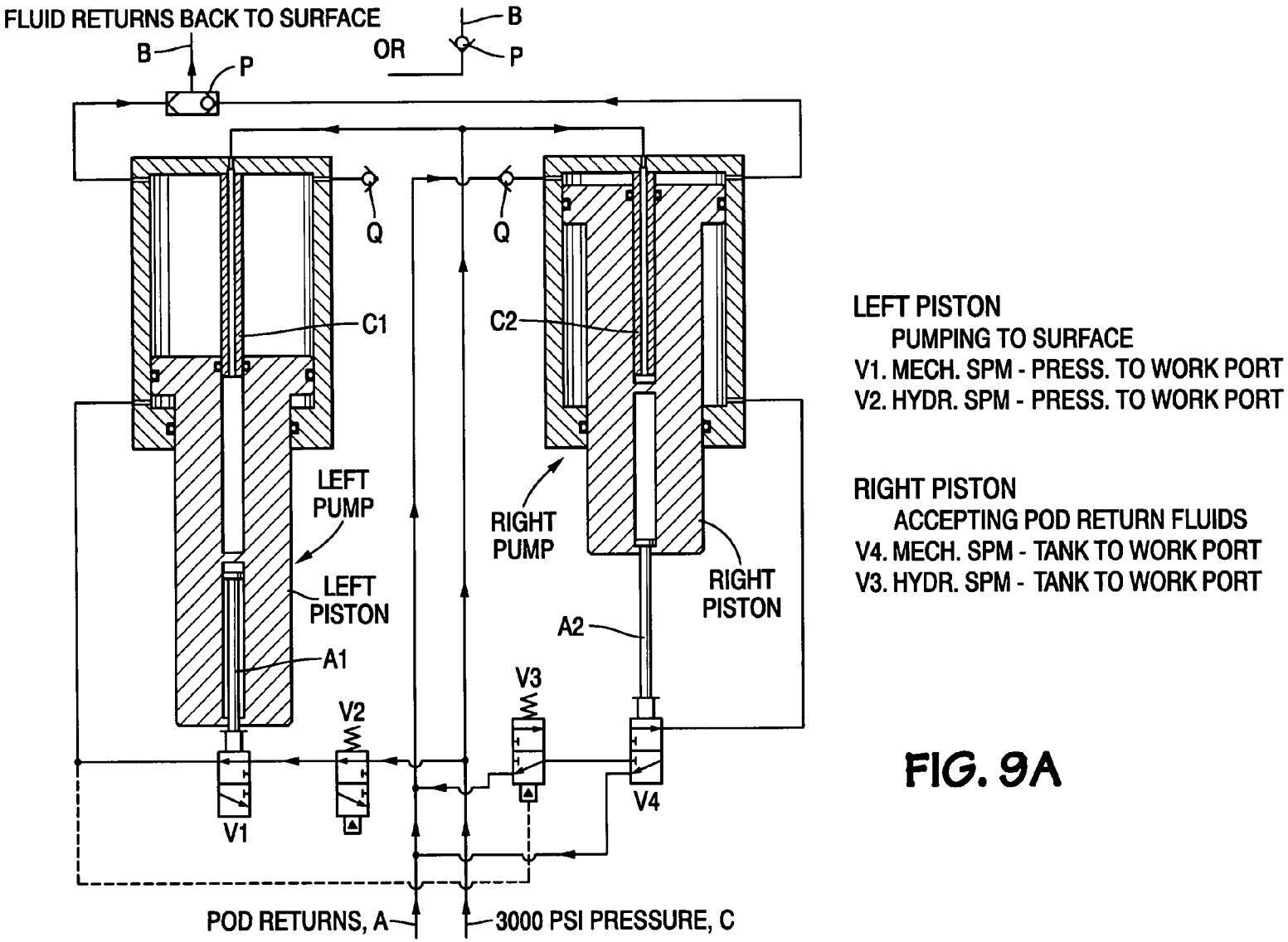
FIG. 9A illustrates a step in a method according to the present invention.
Figure 9B:
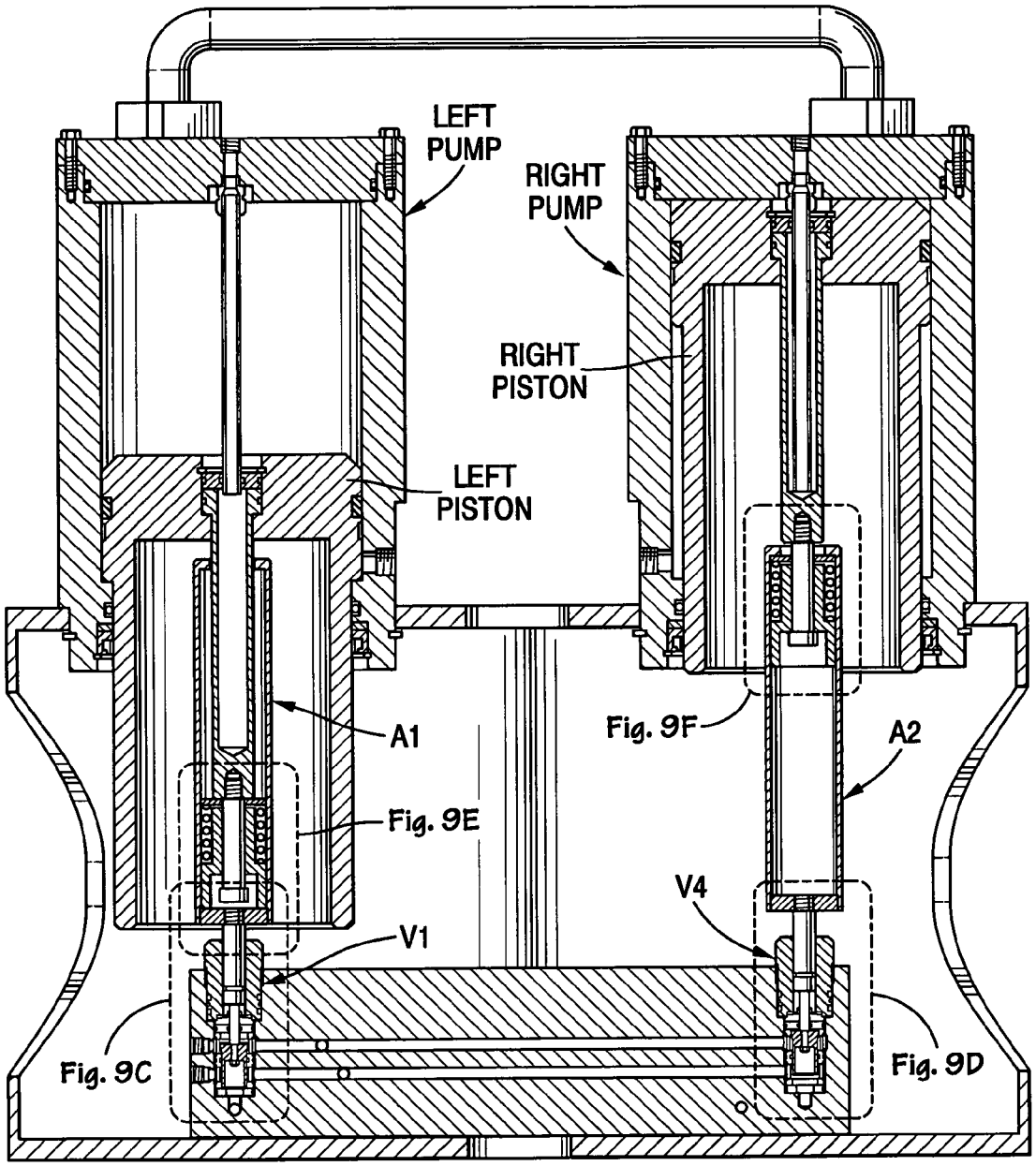
FIG. 9B illustrates positions of various parts in a step as in FIG. 9A.
Figure 9C:
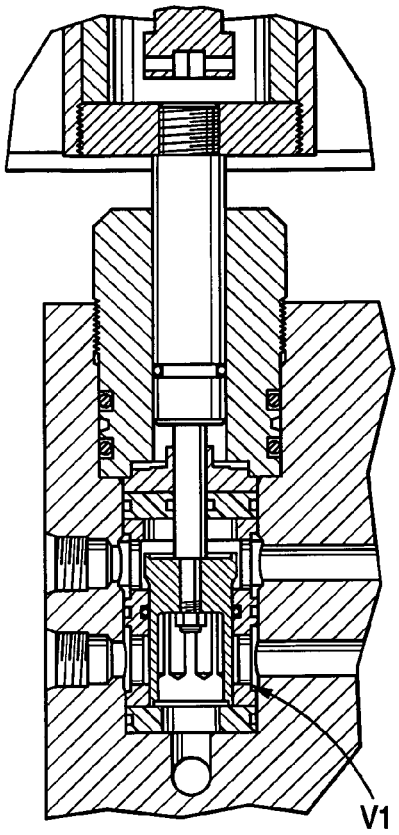
FIG. 9C is an enlargement of a portion of FIG. 9B.
Figure 9D:
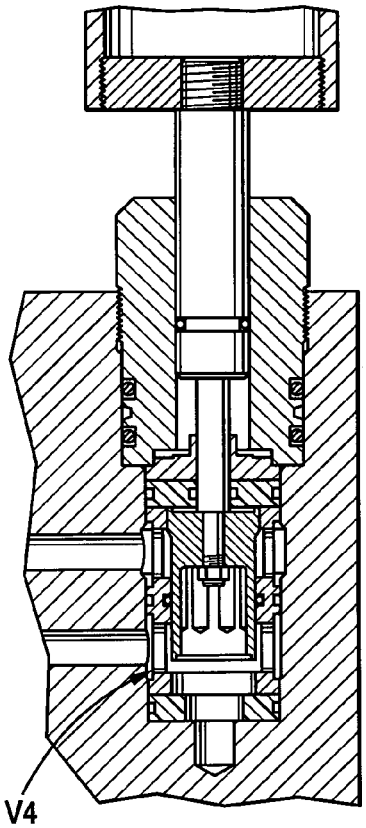
FIG. 9D is an enlargement of a portion of FIG. 9B.
Figure 9E:
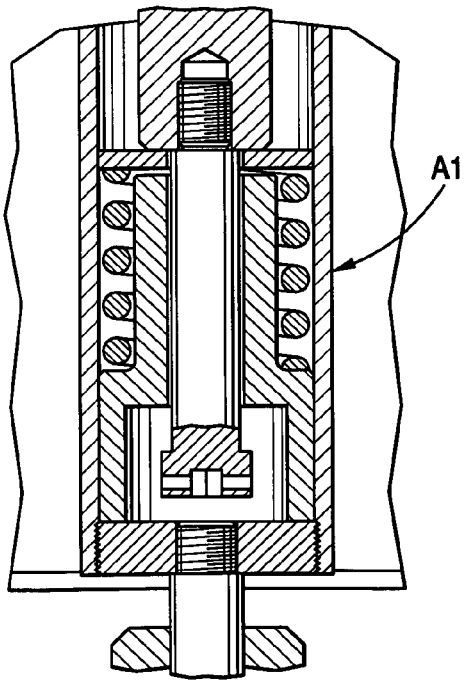
FIG. 9E is an enlargement of a portion of FIG. 9B.
Figure 9F:
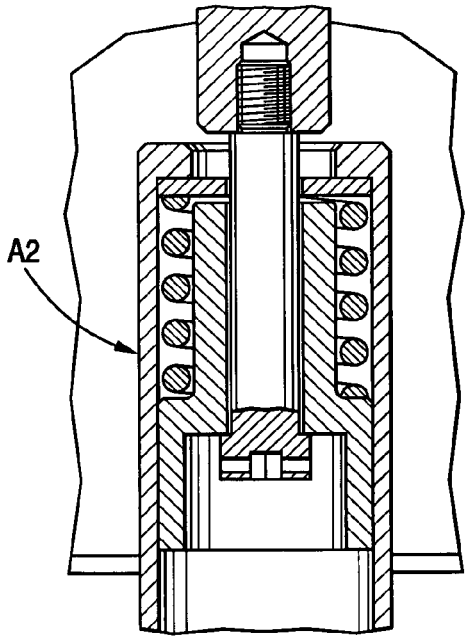
FIG. 9F is an enlargement of a portion of FIG. 9B.

As shown in FIGS. 4A-4D, the pump systems 40, 50 have valve systems 41 and 51 (respectively) including main bodies 42, 52 with valves V1, V2 (body 42) and valves V3, V4 (body 52). The valve V1 includes a mechanical actuator 43 and the valve V4 includes a mechanical actuator 53. As described in detail below, movement of pistons 44, 54 (respectively) results in movement of actuators 45, 55 (respectively) which in turn results in movement of the mechanical actuators 43, 53 during a sequence of operation of the pump systems 40, 50. Optional springs 46 56 provide a "snap" feature for shifting the valves V1, V4 (respectively) between positions to divert flow through various lines. As shown in FIG. 9A, e.g., the lines A, B, C (as in FIG. 2A and FIG. 8) are in communication with the pump systems 40, 50. When the piston 54 is pumped up, a pilot signal is sent from the valve system 51 (from the valve V4) to the valve system 41 (to the valve V2) which vents a pressure chamber CR around a main piston 44 (or vice-versa regarding the chamber CR around the piston 54 when the main piston 44 is pumped up) so that the piston 44 is not pumped up, i.e., so that both pistons do not pump fluid to the surface simultaneously. When a valve system's mechanical activator 45 or 55 is moved up (e.g. when a piston 44 or 54 pulls up on an activator 45 or 55), a line is opened by action of a valve V1 or V4 and a line is closed so that a chamber CR around a main piston 44 or 54 is vented in the line B to tank. When one of the activators 45 or 55 pushes down on an activator 43 or 53, this chamber CR (one chamber CR around each of the pistons 44, 54) fills with pressurized fluid pressurizing the chamber to push that piston up, pushing the fluid on the top that piston out of the pump into the line B back to the surface.

Figure 5:
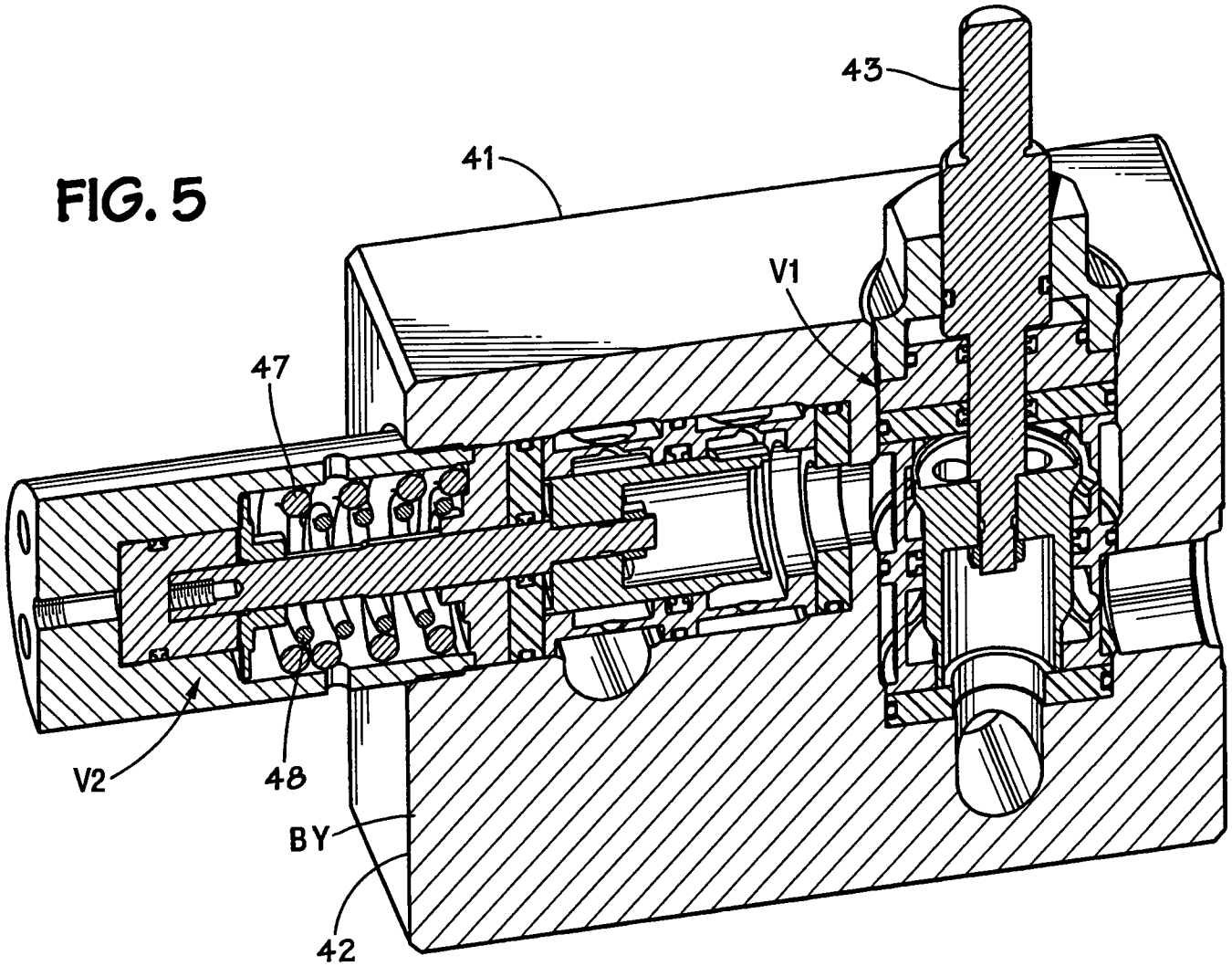
FIG. 5 is a cutaway perspective view of a valve according to the present invention used in systems according to the present invention.

As shown in FIG. 5 the valve V2 is hydraulically actuated for closing and actuated open by the force of springs 47, 48. As shown in FIG. 5 the valve V2 is open by pilot pressure (e.g. from the outlet of the valve V4 as seen in FIG. 12A). The valve V1 is mechanically actuated via the mechanical actuator 43 (both to open and to close the valve V1). As shown in FIG. 5 the valve V1 is open. The other valve systems herein, e.g. the valve system 51 and those of FIGS. 9A-12A, may be like the valve system 41 shown in FIG. 5.

FIG. 7 illustrates the equalization of the pressure of power fluid in a line LN from a fluid recovery system FRS according to the present invention with the pressure of seawater at depth (e.g., but not limited to, at a depth of 10,000 feet). The power fluid (e.g. to power an apparatus 23) in this instance is slightly less dense than is the seawater, resulting in a pressure differential of about 120 psi. So that seawater is not sucked into the Line LN via a "Low Pressure Protect" check valve W and pumped to the surface, a relief valve VL is placed in the line LN between a reserve system 20 (with a bottle or bottles 21, if any) and a surface reservoir ("Return tank"). For example, the relief valve VL is set at 120 psi (the pressure differential) and, if the pressure in the line LN drops below the setting of the valve VL (e.g. 120 psi) the relief valve VL closes the line LN to flow (e.g. until more power fluid is to be pumped to the surface by the system FRS in a line LE leading to the system FRS). The system FRS has a pump system PS (or pump systems) (e.g. like any pump system according to the present invention, e.g. like the pump systems 40, 50 or those shown in FIGS. 8A, 9A-12A). A check valve V (like the check valve X, above) provides high pressure protection. Check valves G and H (like the check valves P and Q, above) provide a check valve function on either side of a line LE to the system FRS.

Figure 8B:
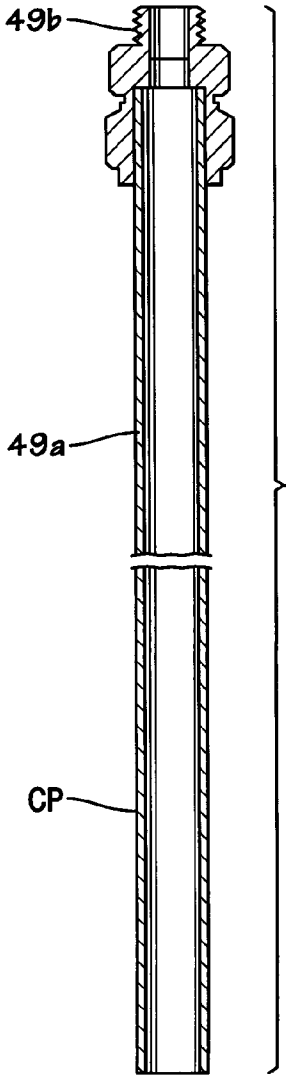
FIG. 8B is a cross-section view of a compensator piston of the pump of FIG. 8A.
Figure 8A:
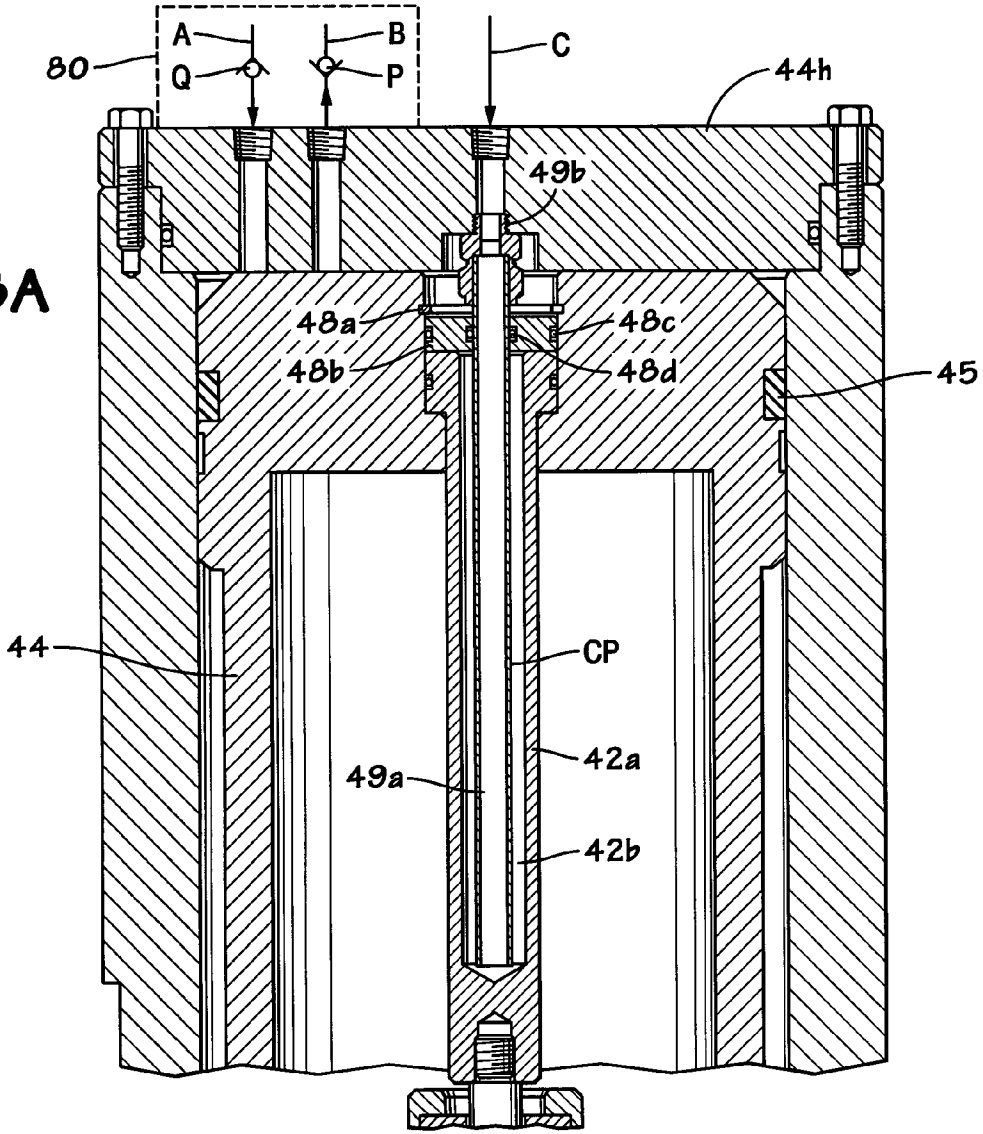
FIG. 8A is an enlargement in cross-section of part of a pump of a system according to the present invention, e.g., a pump as in FIG. 4A, 8, or 9A.

FIG. 8A illustrates part of the interior structure of a pump system 40 (and of a pump system 50; and of the pumps in FIGS. 9A-12A). A fluid recovery system with such a pump system ("PUMP SYSTEM") is shown schematically in FIG. 8. An embodiment of the system 10 ("POWER FLUID RECOVERY SYSTEM") has a reserve capacity apparatus (as may any embodiment of the present invention) which equalizes pressure between the exterior water (e.g. sea water outside) and the hydraulic fluid returns, e.g., but not limited to (as is the case for any embodiment herein) bottles like the bottles 20, 30, FIG. 2A ("RESERVE CAPACITY BOTTLES") which recover hydraulic fluid from a blowout preventer operator ("BOP OPERATOR"), flow to which is controlled by a control valve ("CONTROL VALVE") which itself is controlled by a drive control ("VALVE DRIVE CONTROL"). The pump system ("PUMP SYSTEM") (e.g. like the systems 40, 50) with a valve system VS (like the systems 41, 51) receives fluid from the blowout preventer operator (in a line A) and pumps it in a line B back to a surface reservoir ("TANK"). An optional relief valve ("RELIEF VALVE") provides for equalization of pressure due to the density differential discussed above. The pump system may have any desired number of pumps (like those of the systems 40, 50).

Check valves as indicated in the various lines provide a check valve function. The two check valves labeled X and Y provide high pressure protection (valve X) and low pressure protection (valve Y) (e.g. like the valves V and W, FIG. 7). Accumulator containers at the surface ("SURFACE ACCUMULATOR BOTTLES") serve as containers for fluid pumped from the tank; and optional subsea containers ("ACCUMULATOR SYSTEM") provide an accumulator function at the level of the Power Fluid Recovery System.

As shown in FIG. 8A, via the line C, a constant flow of fluid under pressure is provided to the Pump System's pump which maintains the negative internal pressure in the pump as discussed above. Via the line A (like line A, FIG. 2A), the pump receives fluid exhausted from the BOP operator and, via the line B (like line B, FIG. 2A), the pump pumps the fluid back to the surface. The piston 44 movably disposed in the housing 44*h* is movable (downwardly as shown in FIG. 8A) in response to exhausted power fluid being introduced into the housing 44*h* and the piston 44 is movable (upwardly as shown in FIG. 8A) to pump the fluid into the line B and to the surface. In such movement, the piston 44 overcomes any friction drag due to a seal 45 that seals the piston/housing interface. As shown in FIGS. 9A-12A, the piston 44 is movable to contact and move a valve actuator of a valve system 41 or 51.

The piston 44 has a central member 42*a* with a hollow channel 42*b* therein. Releasably secured to the housing 44*h* is a compensator piston CP (shown in FIG. 8B) with a hollow channel 49*a* therethrough. Fluid under pressure flowing through the line C flows into, down, and through the compensator piston CP and up into the hollow channel 42*b*. The pressure of this fluid pushes against the piston 44 pushing the piston 44 away from the top inner surface of the housing 44*h*. The pressure in the line A is maintained less than the pressure of water exterior to the housing 44*h*. The force applied to the main piston 44 through the compensator piston CP assists the main piston 44 in overcoming friction drag due to the seal 45. The compensator piston CP is connected to the housing 44*h*, e.g. with a threaded coupling 49*b*. A snap ring 48*a* holds a gland 48*b* in place around the compensator piston CP. The gland 48*b* includes a seal 48*c* which seals the gland/housing interface. A seal 48*d* on the interior of the gland seals the gland/compensator-piston interface.

In certain aspects, several interchangeable compensator pistons are provided with different effective diameters permitting fine tuning of the suction characteristics of the pump ("fine tuning"—referring to the ability to select the negative pressure level desired by selecting a particular compensator piston (so the line A is maintained at a negative pressure so the reserve capacity bottles remain fully evacuated of all power fluid and the bladders therein remain full of water (water from exterior to the bottles) until the BOP operator functions and power fluid used to operate the BOP operator which is exhausted from the BOP operator is to be pumped to the surface.

FIG. 8B shows the compensator piston CP. The compensator piston CP is secured to the housing 44*h* with the threaded coupling 49*b*. Since the piston CP is fixed to the housing 44*h*, fluid entering in the line C and flows down through the piston CP and up into the space around the piston CP, resulting in a force pushing the piston 44 downward. Thus, as this piston tries to draw fluid in the pump via the check valve Q, a negative pressure is maintained in the return line A and movement of the piston 44 is facilitated.

Figure 3B:
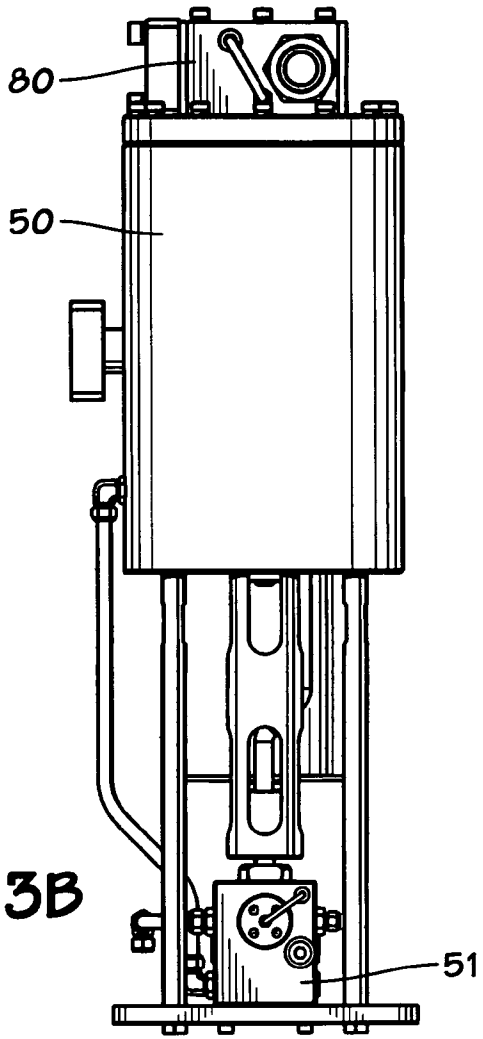
FIG. 3B is a side view of the part shown in FIG. 3A.
Figure 3A:
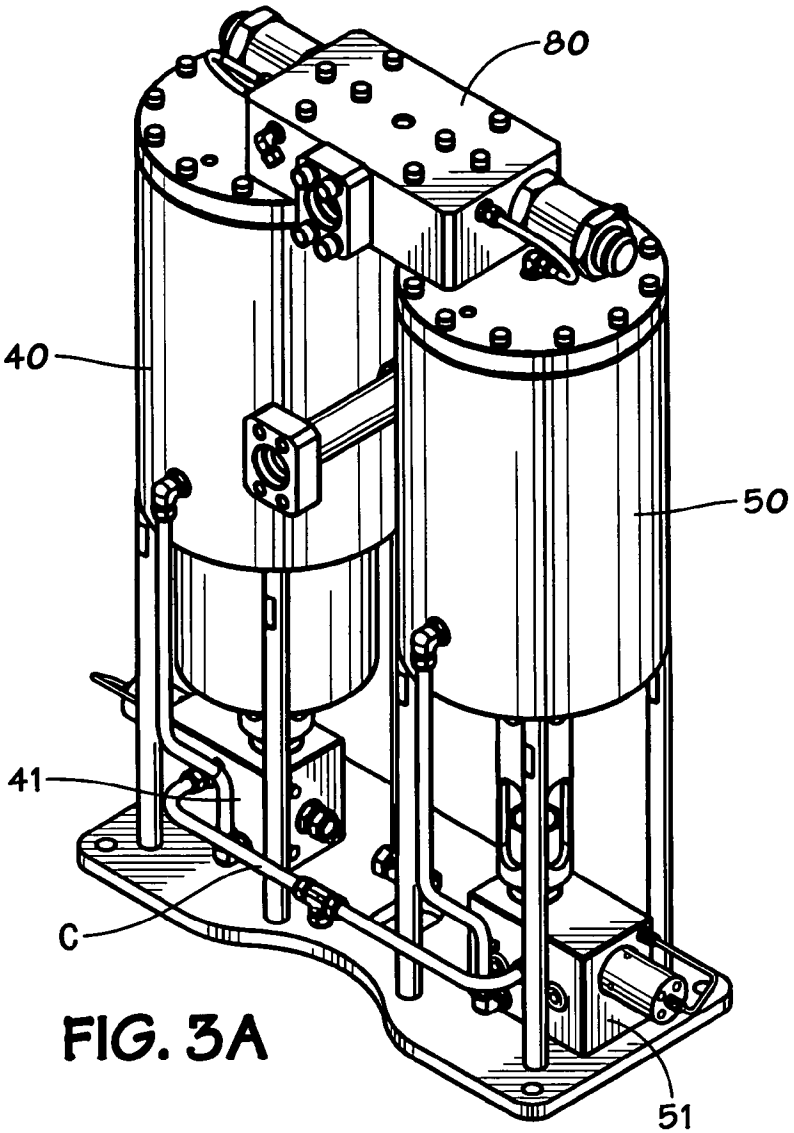
FIG. 3A is a perspective view of part of the system of FIG. 2A.
Figure 4A:
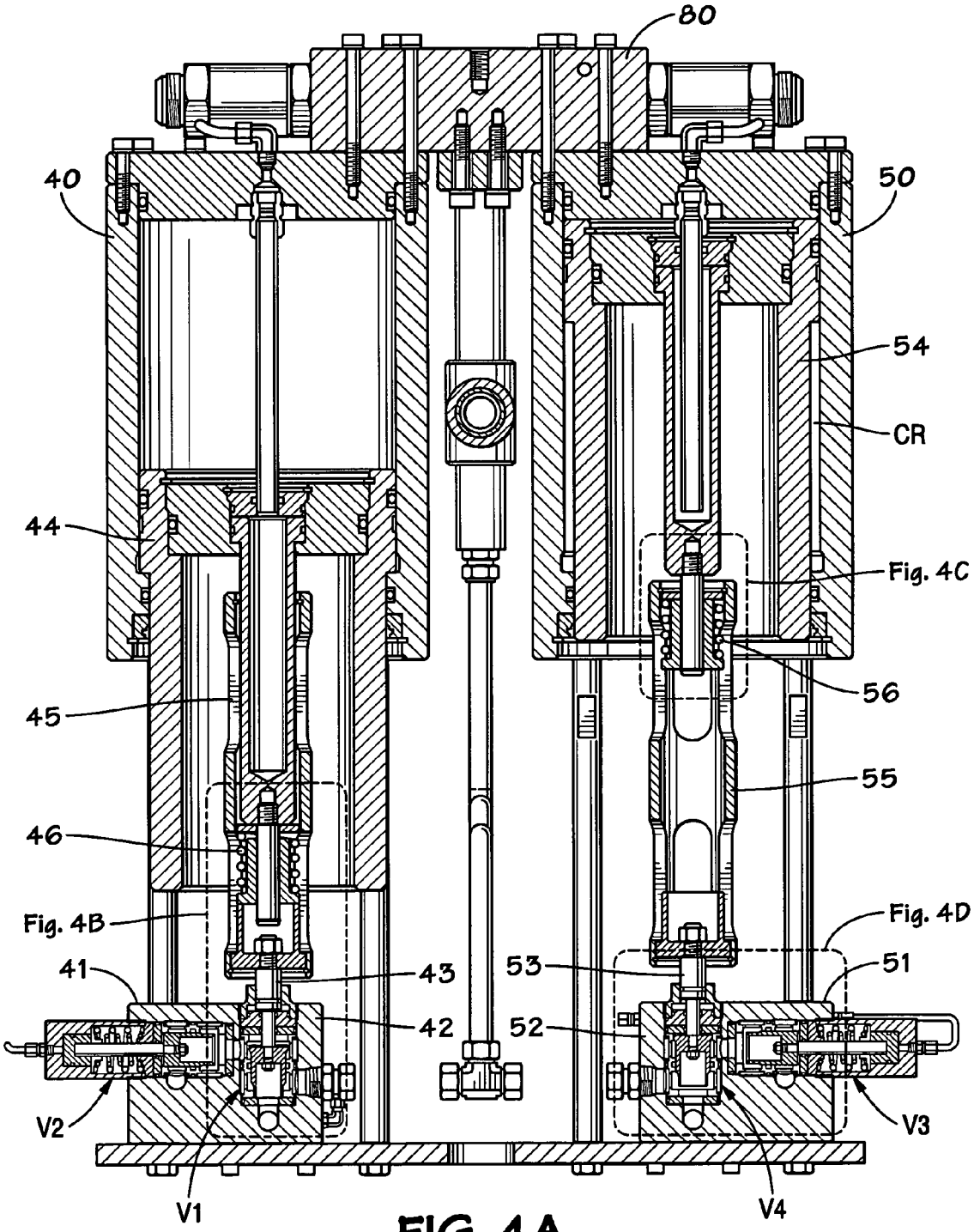
FIG. 4A is a cross-section view of the part shown in FIG. 3A.
Figure 4C:
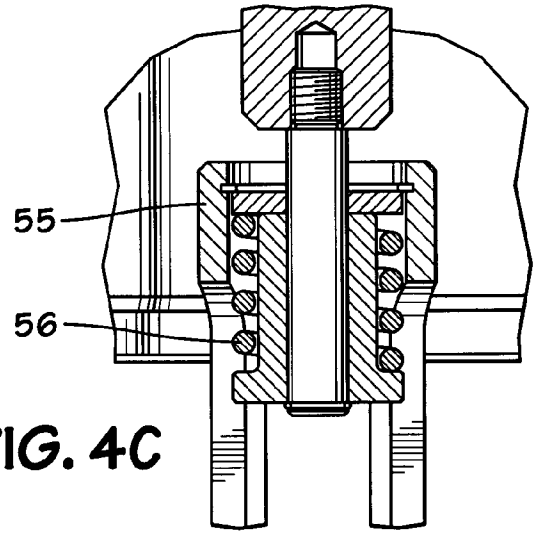
FIG. 4C is an enlargement of a portion of the part shown in FIG. 4A.
Figure 4D:
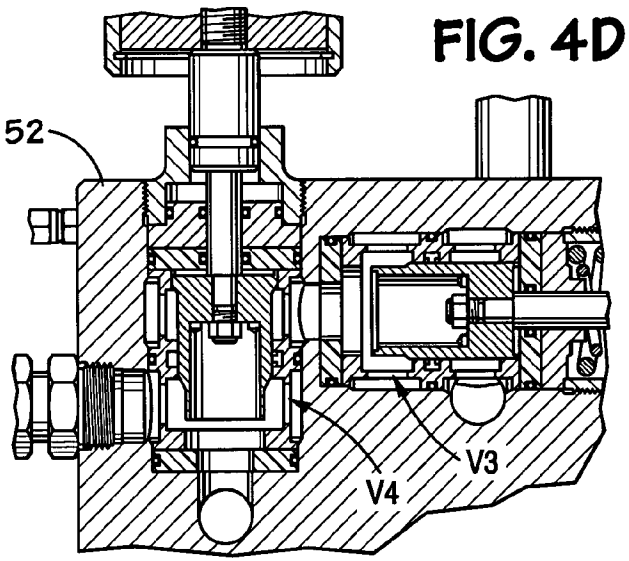
FIG. 4D is an enlargement of a portion of the part shown in FIG. 4A.
Figure 4B:
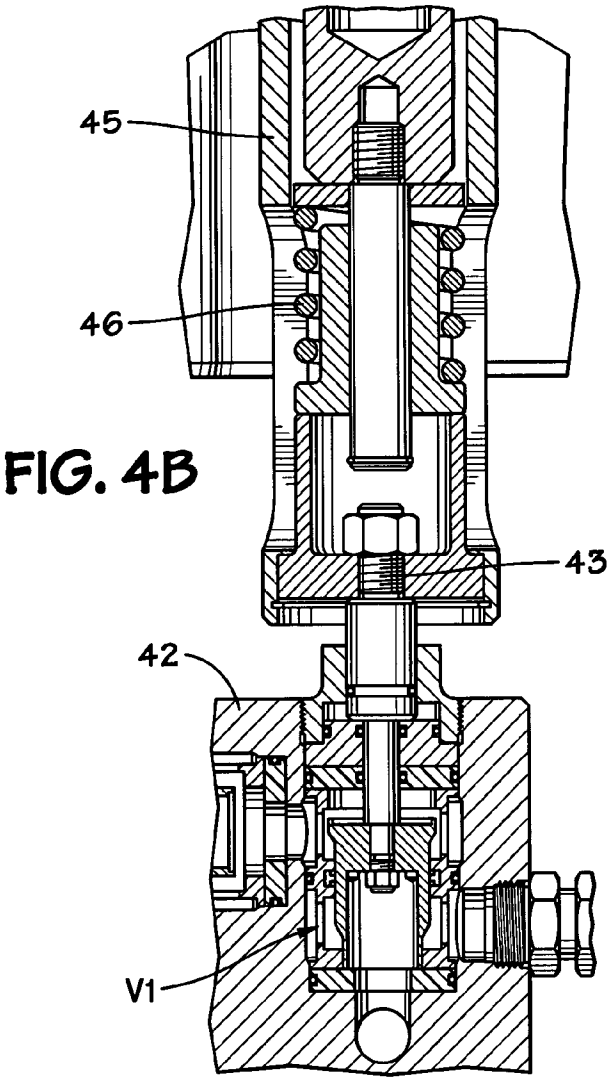
FIG. 4B is an enlargement of a portion of the part shown in FIG. 4A.

FIGS. 9A-12F illustrate steps in methods according to the present invention using a fluid recovery system according to the present invention which has two pumps (e.g., like the pumps of the systems of FIGS. 2A, 3A, 8A). One pump is a "Left Pump" (with a "Left Piston") and one pump is a "Right Pump" (with a "Right Piston") (see FIG. 9A).

The line labelled "FLUID RETURNS BACK TO SURFACE" is the line through which the pumps pump power fluid back to the surface and corresponds to line B, FIG. 8 and FIG. 8A. The line labelled "POD RETURNS" is the line through which the pumps receive exhausted fluid, corresponding to line A, FIG. 8 and FIG. 8A. In the line labelled "3000 PSI PRESSURE" fluid is supplied from the accumulator system, corresponding to the line C, FIG. 8A (of course the pressure in this line is not limited to 3000 psi and may, according to the present invention, be any suitable pressure).

As shown in FIGS. 9A, 10A, 11A and 12A, systems according to the present invention may have a series of valves V1, V2, V3, V4 (e.g. within a body like the body BY, FIG. 2A) for controlling fluid flow to and from the pumps to effect efficient and continuous pumping of fluid from a powered downhole apparatus or device to the surface. In one aspect the valves V1-V4 are as indicated in FIGS. 4A-4D. Valves V1 and V4 are mechanically operated by movement of the Left Piston and Right Piston moving corresponding mechanical valve actuators A1 and A2 (like the mechanical actuators 43, 53, FIG. 4A).

FIG. 9A ("STEP 1") illustrates fluid pressure from the line C pushing the Left Piston up to pump power fluid (previously supplied through line A) into the line B from above the Left Piston. The Left Piston has previously moved down, pushing the valve actuator A1 down to activate the valve V1 to allow fluid under pressure in the line C to enter below the Left Piston.

Also as shown in FIG. 9A, as the Left Piston is pumping fluid into the line B, the housing of the Right Piston is beginning to receive exhausted power fluid via the line A (through the check valve Q) which is flowing into the space above the Right Piston for eventual pumping to the surface. The Right Piston has previously moved the mechanical valve actuator A2 to operate the valve V4 to close the valve V4 (so that no further power fluid enters below the Right Piston and the fluid from beneath the Right Piston is allowed to vent to the line A). In FIG. 9A, valve V2 is opened by the spring force of its spring so that fluid under pressure is allowed to flow to the valve V1 from the line C. Also, as shown in FIG. 9A, fluid under pressure in the line C flows to the compensator piston C1 (like the compensator piston CP, FIG. 8B) of the Left Pump and to the compensator piston C2 (like the compensator piston CP, FIG. 8B) of the Right Pump. Valve V3 closes off flow from the line C to the Right Pump (thereby venting fluid to line A from the bottom of the Right Piston). The dotted line in FIG. 9A (and in subsequent figures) indicates a pilot line for providing a pilot signal to the valve V3 to insure that fluid from the bottom of the Right Piston is vented to the line A regardless of the position of the valve V4 (so that in certain positions, e.g. as in FIG. 9A, the Right Piston cannot pump exhausted power fluid to the surface; i.e., so that only one pump pumps exhausted power fluid to the surface at a time). "Mech SPM" refers to a mechanically actuated valve (e.g. V1, V4) and "Hyd SPM" refers to an hydraulically actuated valve (e.g. V2, V3). "Work Port" refers to a port from the chambers CR.

Figure 10A:
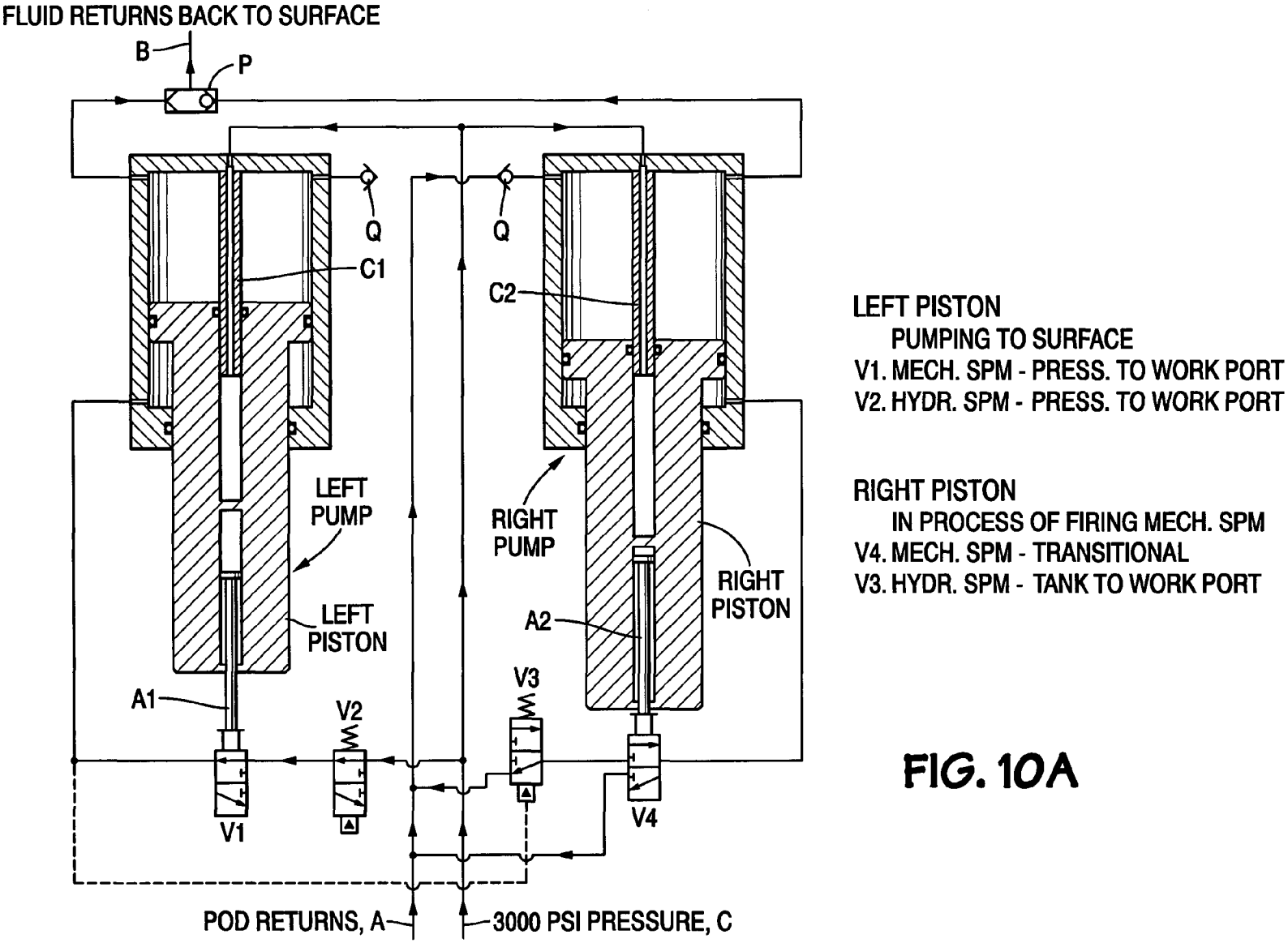
FIG. 10A illustrates a step in a method according to the present invention.
Figure 10B:
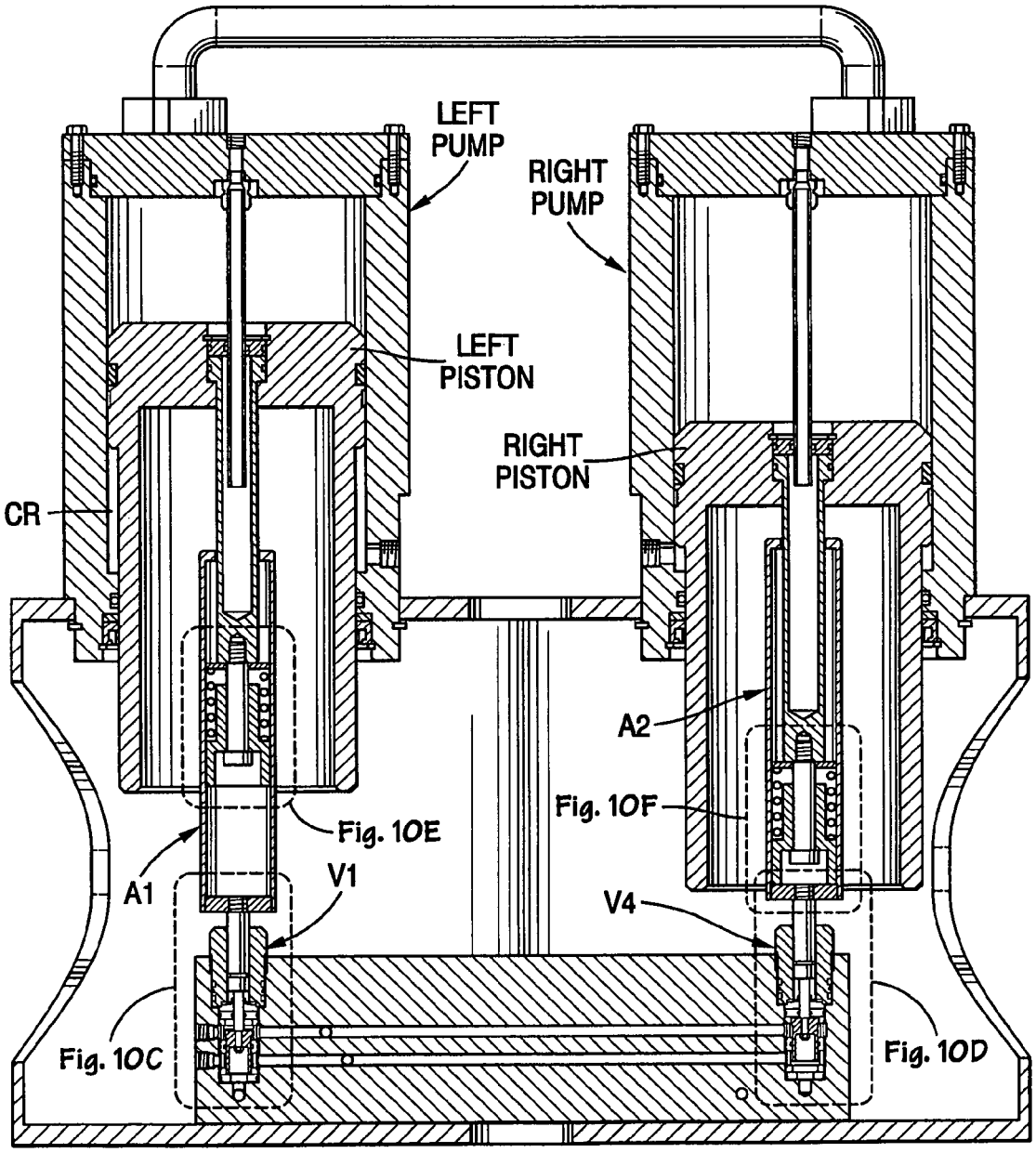
FIG. 10B illustrates positions of various parts in a step as in FIG. 10A.
Figure 10C:
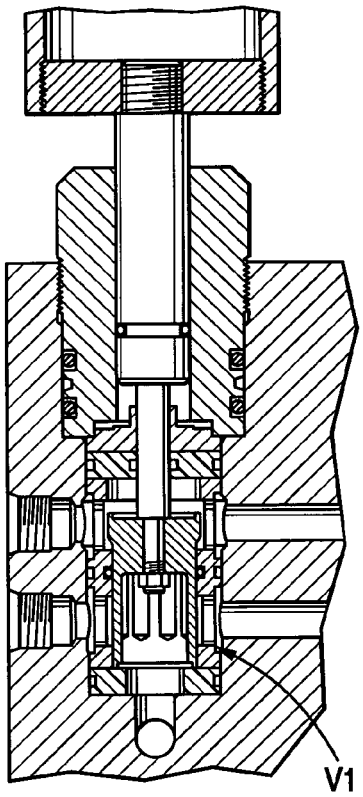
FIG. 10C is an enlargement of a portion of FIG. 10B.
Figure 10D:
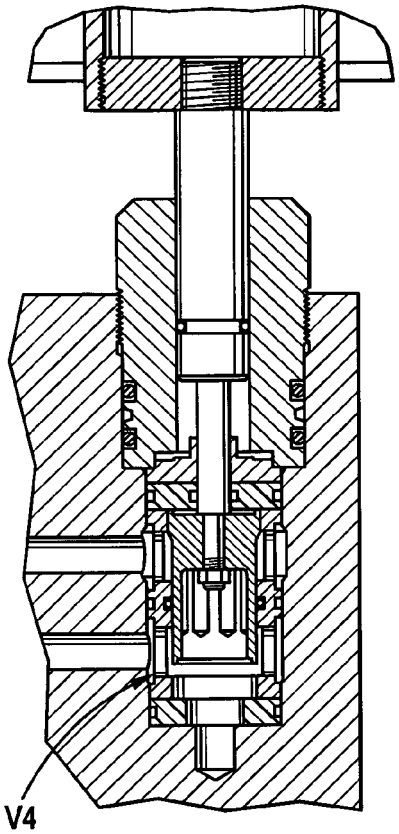
FIG. 10D is an enlargement of a portion of FIG. 10B.
Figure 10E:
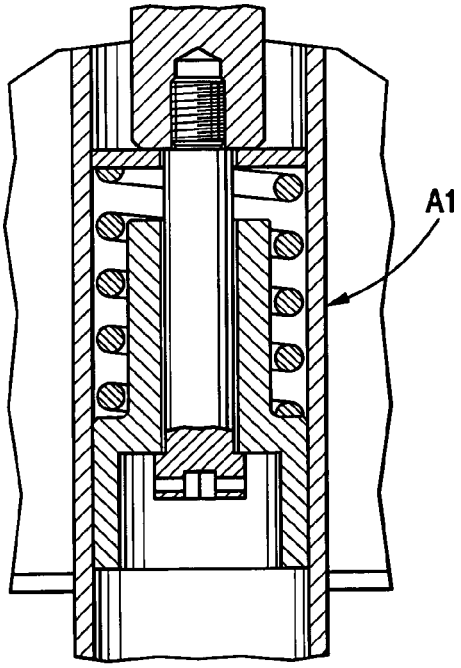
FIG. 10E is an enlargement of a portion of FIG. 10B.
Figure 10F:
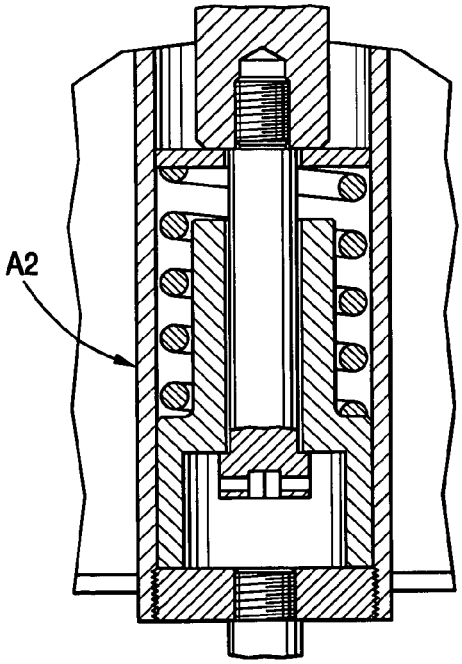
FIG. 10F is an enlargement of a portion of FIG. 10B.

As shown in FIG. 10A ("STEP 2") the Left Piston is in the process of pumping fluid to the surface and the Right Piston is in the process of moving the actuator A2 down to actuate the valve V4 ("firing") to stop further power fluid "POD RETURNS" from flowing to the Right Piston. The valve V2 is still permitting fluid under pressure to flow beneath the Left Piston as it continues to pump fluid to the surface and the valve V3 is receiving the pilot signal which keeps the valve V3 shifted to a closed position (as in FIG. 9A) while fluid from the line C is provided to the bottom of the Left Piston. As shown in FIGS. 9A and 10A, no pressure from the line C is applied beneath the Right Piston so the Right Piston cannot go up when the Left Piston is going up. (Thus only one pump pumps power fluid to the surface at a time).

Figure 11A:
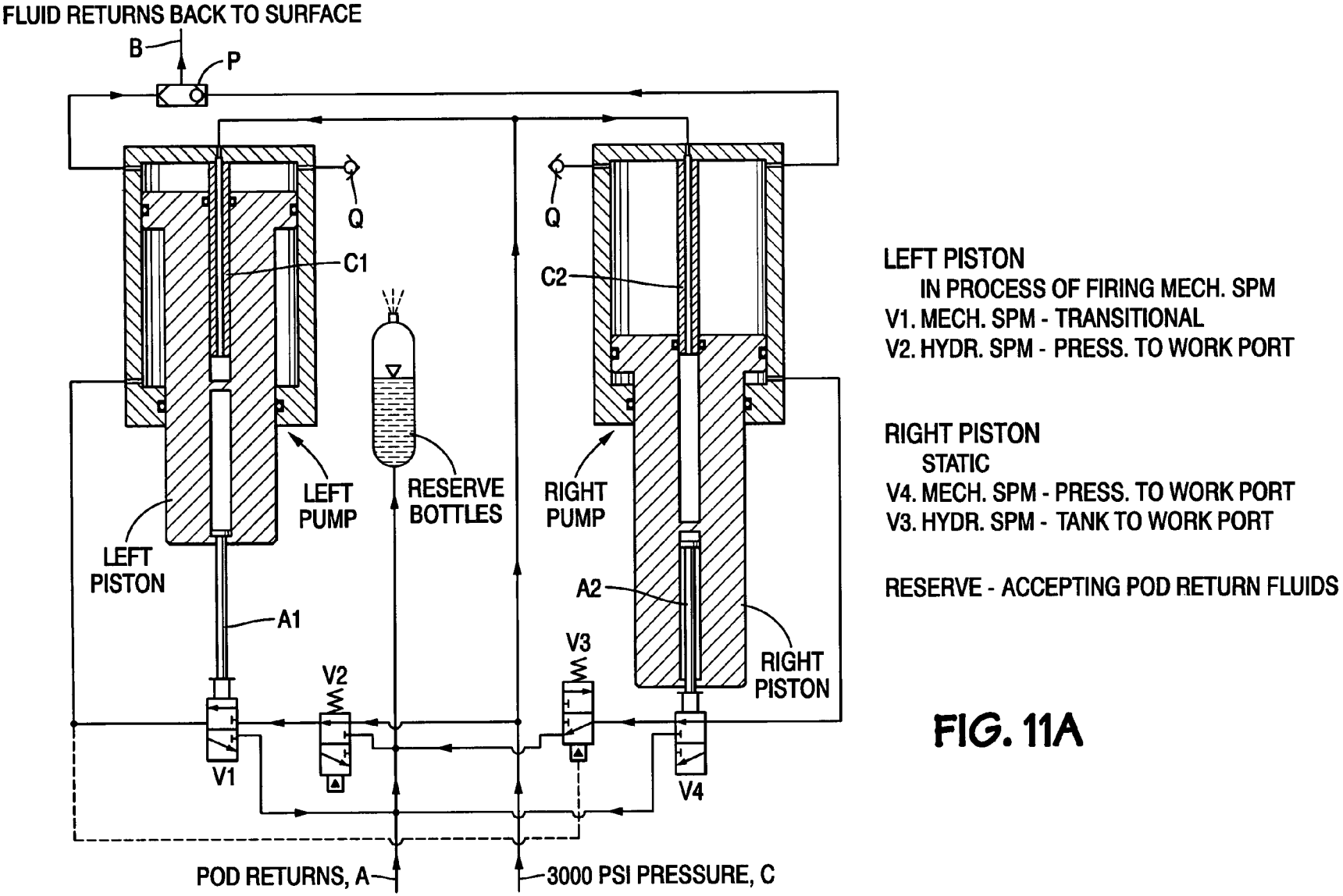
FIG. 11A illustrates a step in a method according to the present invention.
Figure 11B:
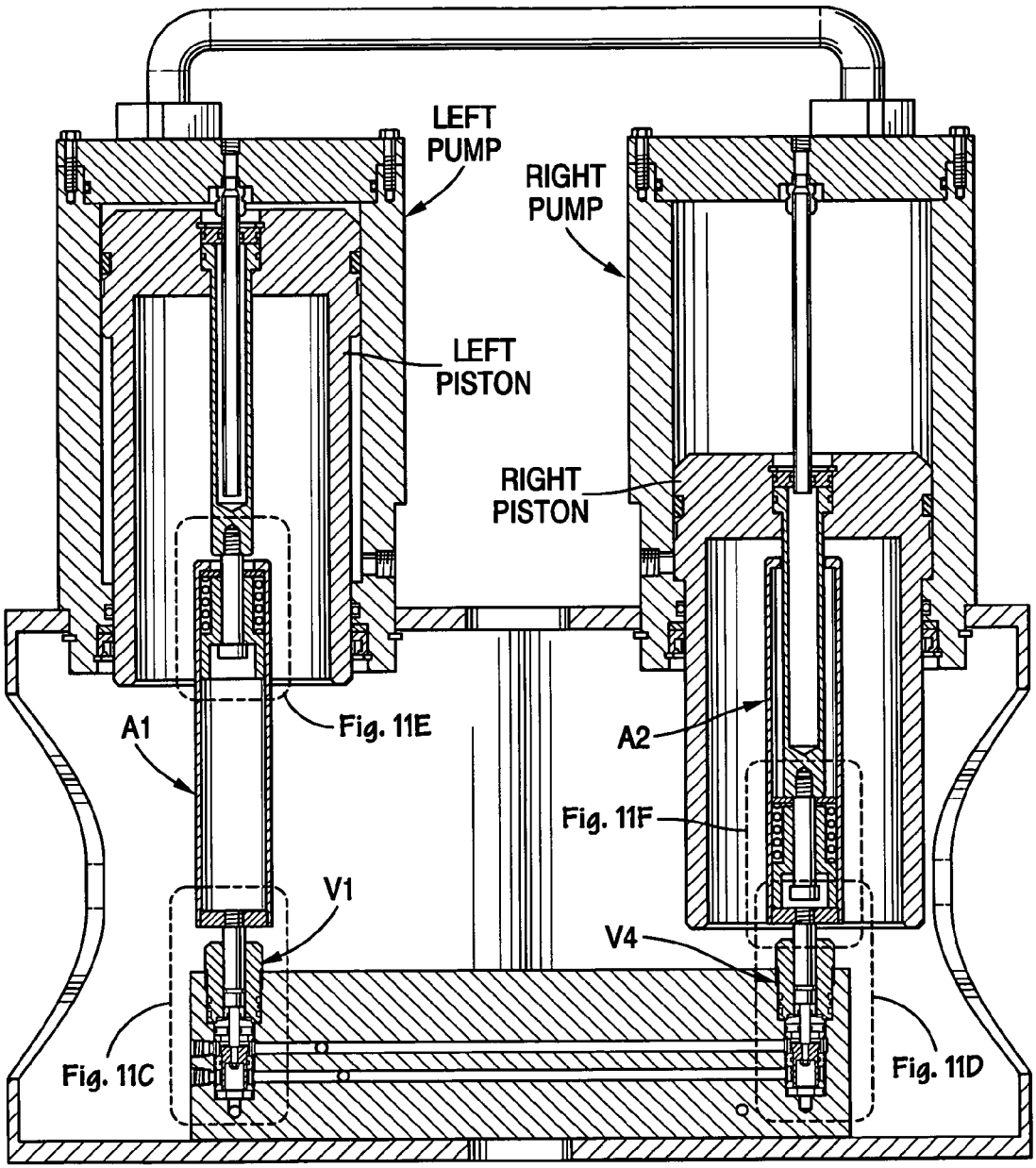
FIG. 11B illustrates positions of various parts in a step as in FIG. 11A.
Figure 11C:
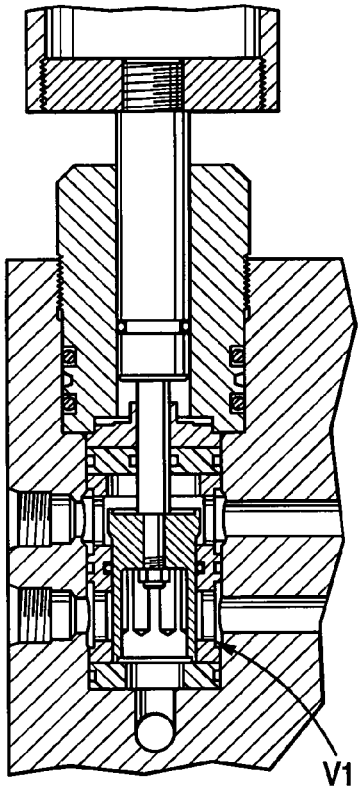
FIG. 11C is an enlargement of a portion of FIG. 11B.
Figure 11D:
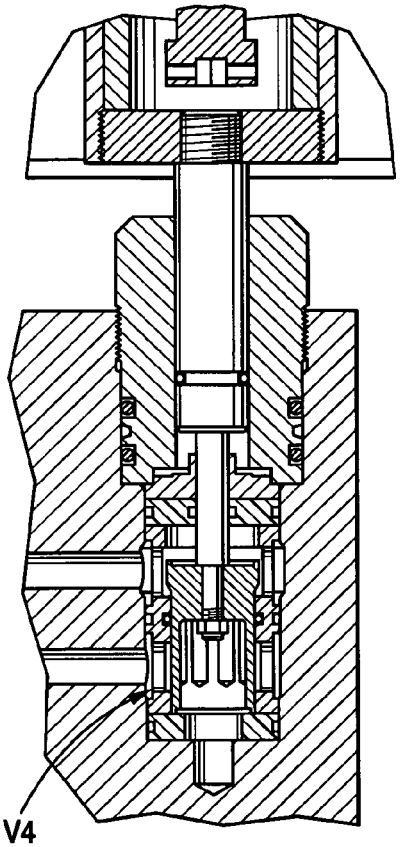
FIG. 11D is an enlargement of a portion of FIG. 11B.
Figure 11E:
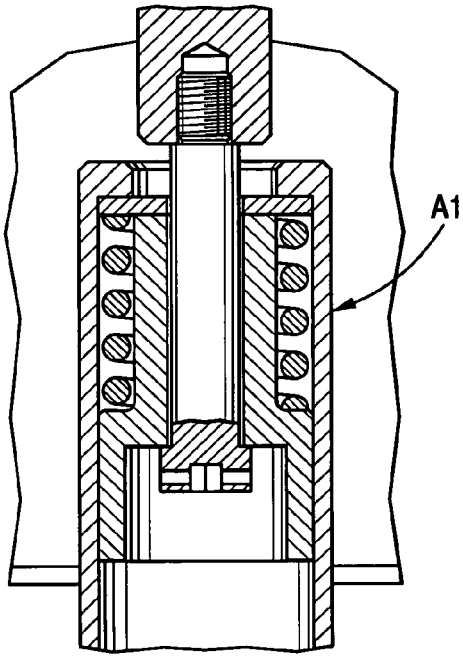
FIG. 11E is an enlargement of a portion of FIG. 11B.
Figure 11F:
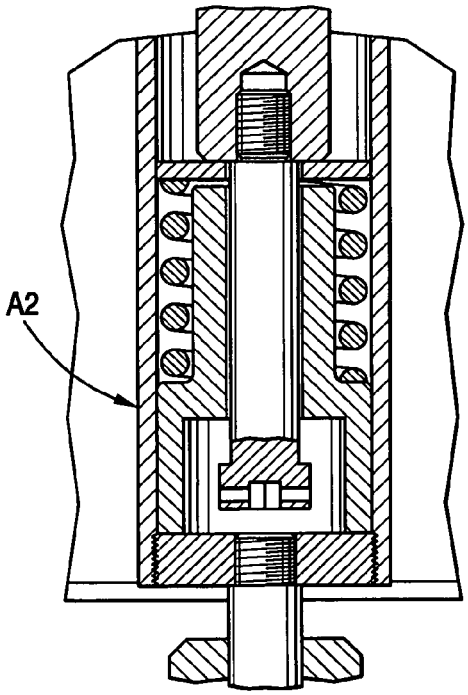
FIG. 11F is an enlargement of a portion of FIG. 11B.
Figure 12A:
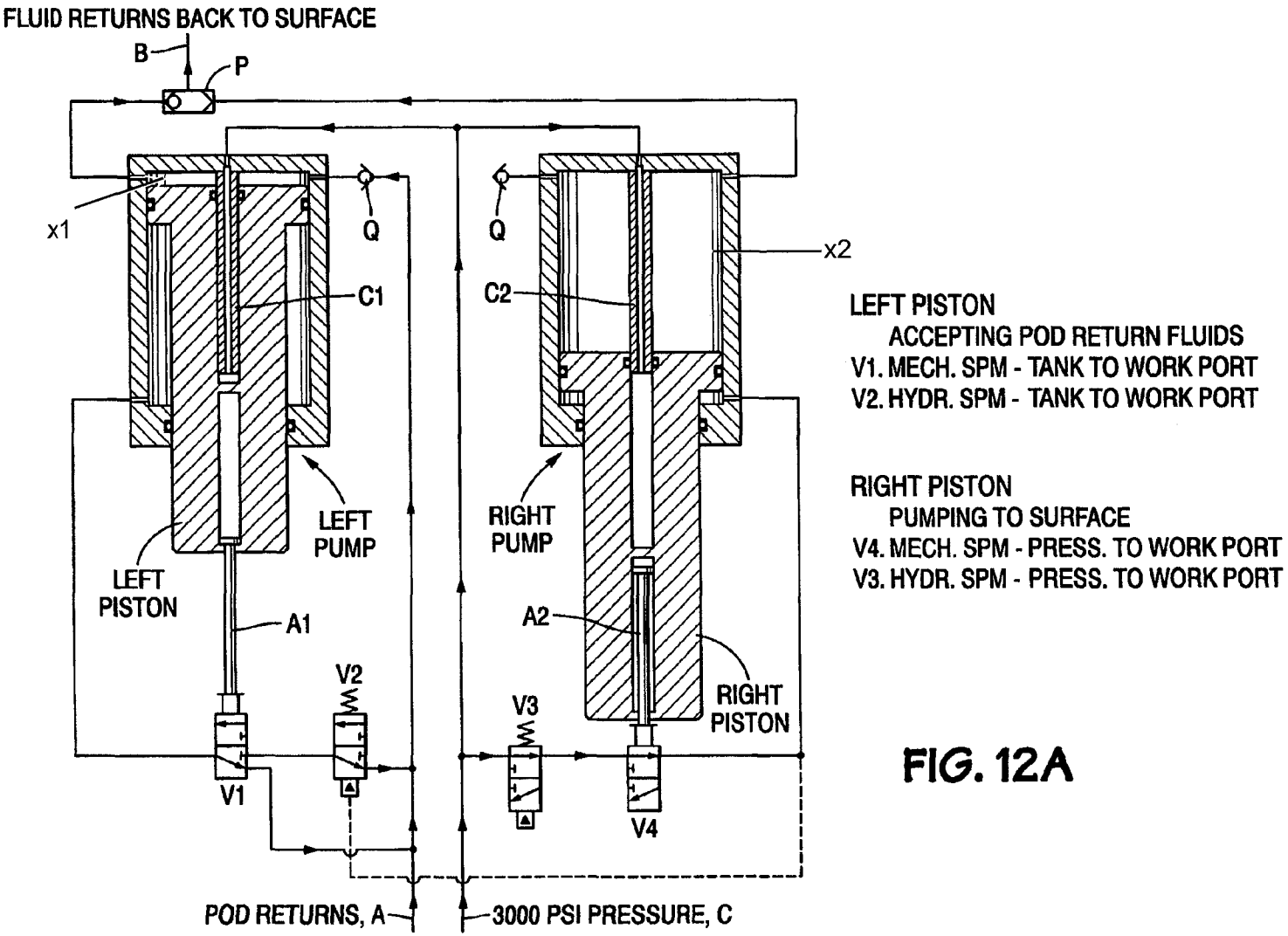
FIG. 12A illustrates a step in a method according to the present invention.
Figure 12B:
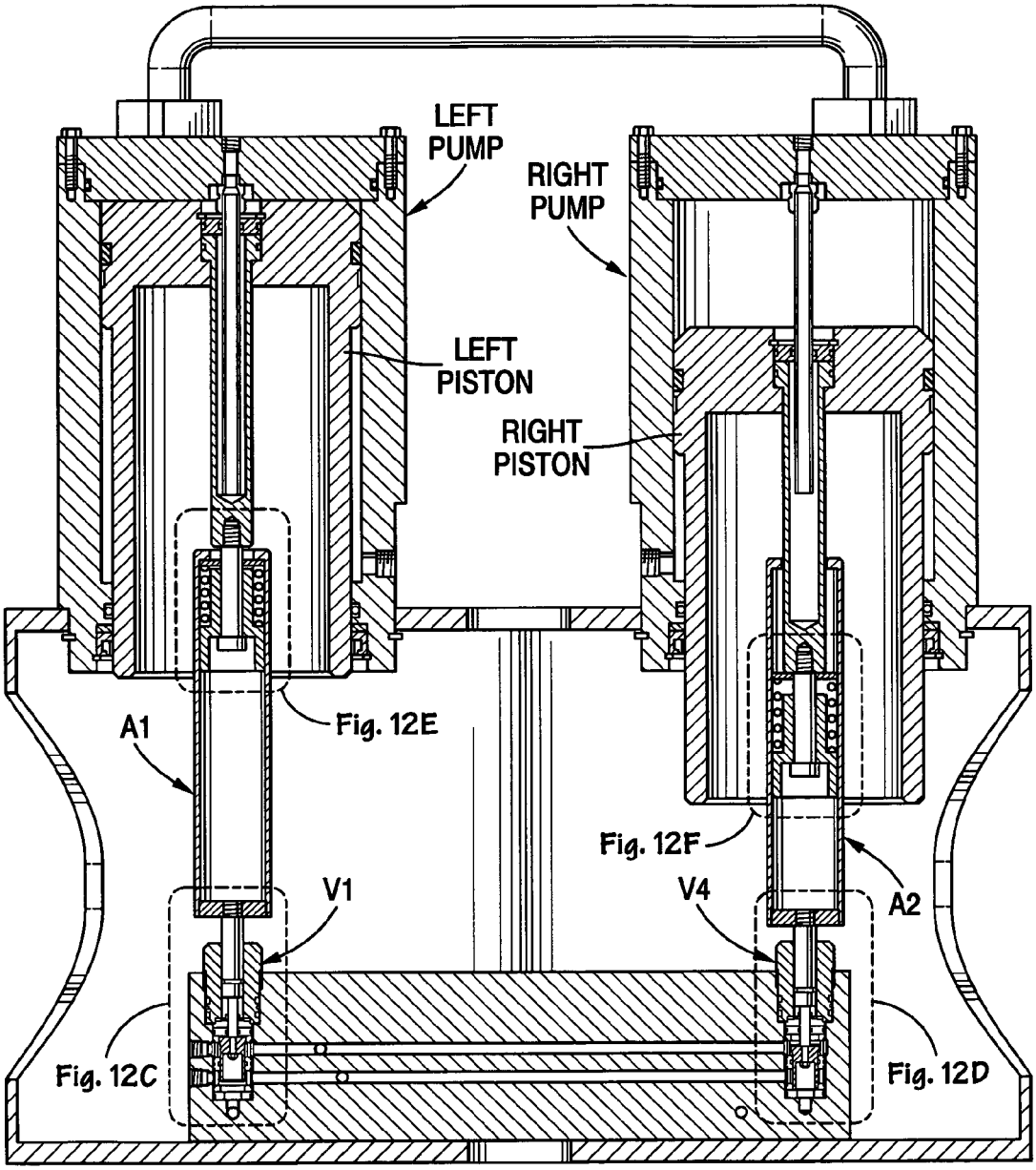
FIG. 12B illustrates positions of various parts in a step as in FIG. 12A.
Figure 12C:
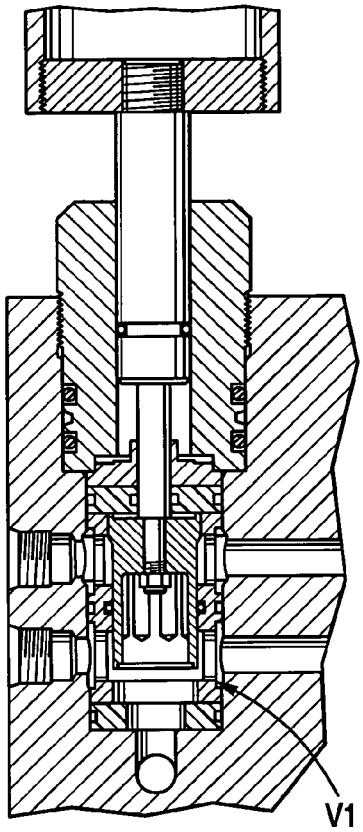
FIG. 12C is an enlargement of a portion of FIG. 12B.
Figure 12D:
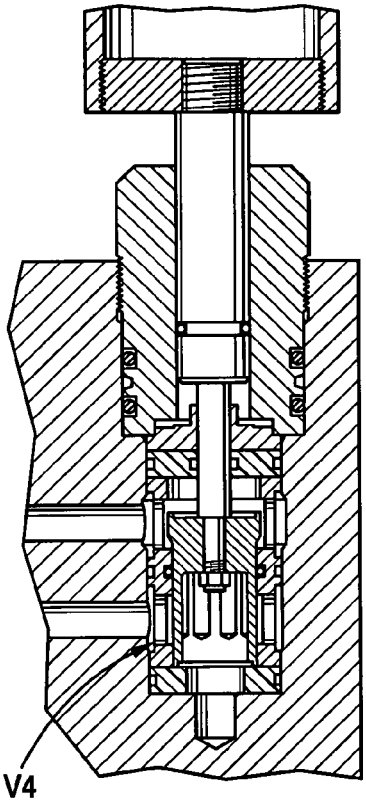
FIG. 12D is an enlargement of a portion of FIG. 12B.
Figure 12E:
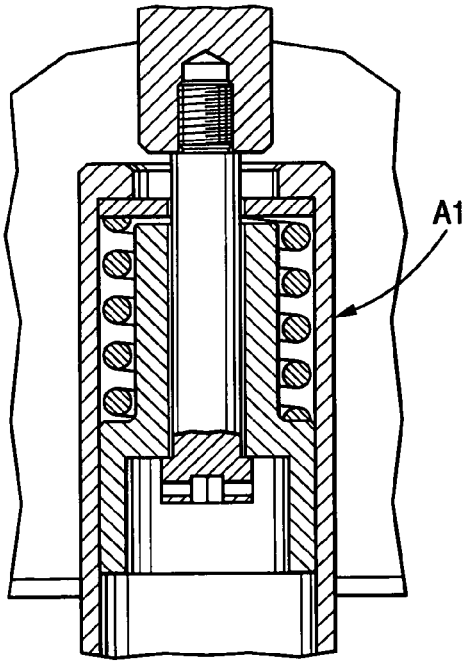
FIG. 12E is an enlargement of a portion of FIG. 12B.
Figure 12F:
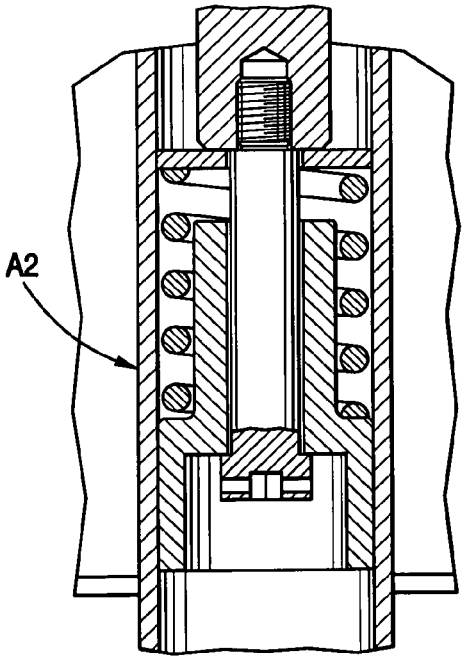
FIG. 12F is an enlargement of a portion of FIG. 12B.

FIG. 11A illustrates the Left Piston approaching the upper limit of its travel, still pumping fluid into the line B, and almost at the point of pulling the mechanical actuator A1 up to the required extent to activate the valve V1 to shut off the flow of fluid under pressure in the line C to the space beneath the Left Piston. No exhausted fluid is flowing into the space above the Left Piston. The space above the Right Piston is filled with exhausted power fluid and the Right Piston as shown is static. The reserve capacity bottles ("Reserve Bottles") are in the process of receiving more power fluid exhausted from the power-fluid-operated downhole device (e.g. a BOP operator). The space above the Left Piston will be substantially evacuated before any more exhausted power fluid is introduced above the Left Piston.

As shown in FIG. 11A, the valve V2 is in the same position as in FIGS. 9A and 10A allowing fluid from the line C to go to the valve V1. The Right Piston, shown as static, is ready to pump fluid above it to the surface via the line B; and the Left Piston is in the process of finishing the pumping of fluid into the line B and of moving ("firing") the valve V1.

As shown in FIG. 12A, exhausted power fluid is flowing into the space X1 above the Left Piston while the Right Piston is moving up and pumping exhausted power fluid to the surface in line B. The valve V1 has been activated to permit fluid from beneath the Left Piston allowing the Left Piston to move down so that the space X1 above the Left Piston can receive exhausted power fluid from the line A. The valve V2 is insuring that fluid from the bottom of the Left Piston can flow to the line A. The valve V4 has been activated to permit fluid under pressure from line C to flow into the space beneath the Right Piston to move it up to pump exhausted power fluid in the space X2 above the Right Piston to the surface in the line B. The pilot signal from the valve V1 is vented to the line A, hence the valve V3 is vented allowing the spring of the valve V3 to shift the valve V3 open allowing fluid through the line C to go to the valve V4 and then to the space below the Right Piston.

In all of the steps, STEP 1-STEP 4, fluid under pressure from the line C is constantly applied to the compensator pistons C1 and C2 to assist in moving the Left and Right Pistons down when the spaces above them are receiving exhausted power fluid.

Accordingly, while preferred embodiments of this invention have been shown and described, many variations, modifications and/or changes of the system, apparatus and methods of the present invention, such as in the components, details of construction and operation, arrangement of parts and/or methods of use, are possible, contemplated by the patentee, within the scope of the invention, and may be made and used by one of ordinary skill in the art without departing from the spirit or teachings of the invention and scope of the invention. Thus, all matter herein set forth or shown in the accompanying drawings should be interpreted as illustrative and not limiting, and the scope of the invention is not limited to the embodiments described and shown herein.

The present invention, therefore, provides in at least certain embodiments, a method for recovering power fluid used to power a device under water and for pumping the recovered power fluid to a fluid container above a surface of the water, the method including: flowing fluid from a subsurface apparatus to a subsurface recovery system, the fluid initially provided to the subsurface apparatus to power the subsurface apparatus; and the subsurface recovery system including a pump system for selectively pumping recovered power fluid to a fluid container above a surface of the water; the pump system including at least one pump, and a valve system, the valve system controlling the at least one pump, and pumping recovered power fluid to the fluid container with the at least one pump. In such a method the at least one pump may have a main piston movably disposed in a main piston chamber in a main piston housing, the main piston housing having a flow channel therethrough in fluid communication with the main piston chamber for providing fluid under pressure from a subsurface recovery system into the main piston housing above the main piston, the method further including introducing fluid under pressure into the main piston chamber through the flow channel to maintain a pressure within the main piston housing less than a pressure of fluid exterior to the at least one pump.

The present invention, therefore, provides in at least certain embodiments, a method for recovering power fluid used to power a device under water and for pumping the recovered power fluid to a fluid container above a surface of the water, the method including: flowing fluid from a subsurface apparatus to a subsurface recovery system, the fluid initially provided to the subsurface apparatus to power the subsurface apparatus; and the subsurface recovery system including a pump system for selectively pumping recovered power fluid to a fluid container above a surface of the water, the pump system including a first pump, a second pump, and a valve system, the valve system controlling the first pump and the second pump to allow only one pump of the first pump and the second pump to pump recovered power fluid to the fluid container above the surface of the water, the method further including pumping recovered power fluid to the fluid container with only one pump at a time of the first pump and the second pump. Such a method may have one or some, in any possible combination, of the following: wherein the pump system includes pilot signal apparatus for supplying a pilot signal to the first pump and to the second pump signalling when one bump of the first pump and the second pump is pumping recovered power fluid to the fluid container so that another pump of the first and second pump receiving said pilot signal is then prevented from pumping recovered power fluid to the fluid container, the method further including sending said pilot signal to the first pump and the second pump and then preventing said another pump from pumping recovered power fluid to the fluid container; continuously pumping recovered power fluid to the fluid container with the pump system using alternately the first pump then the second pump; wherein a definite amount of power fluid powers the subsurface apparatus, the method further including automatically shutting off the pump system when the definite amount of power fluid has been pumped by the pump system to the fluid container; wherein the recovered power fluid is re-used to power the subsurface apparatus; wherein each of the first pump and the second pump has a main piston and an associated mechanically-activated valve actuatable by contact by a corresponding main piston, the method further including moving a main piston of the first pump or of the second pump to contact a corresponding mechanically-actuated valve to close said valve allowing said main piston to move down so that a chamber in which said piston is movable can fill with recovered power fluid to be pumped to the fluid container; wherein each main piston of the first pump and the second pump has an activation member connected thereto for contacting a corresponding mechanically-activated valve and said activation member is spring loaded with a spring device to provide snap action for facilitating contact with and actuation of the mechanically-activated valve, the method further including facilitating actuation with said spring device of the mechanically-activated valves; wherein each pump has a main piston movably disposed in a main piston chamber in a main piston housing, each main piston housing having a flow channel therethrough in fluid communication with a main piston chamber for providing fluid under pressure from a surface fluid system above a main piston, the method further including introducing fluid under pressure into each main piston chamber through the flow channel to maintain a pressure within each main piston housing less than a pressure of fluid exterior to the pump system; wherein each of the first pump and the second pump has a main piston movably disposed in a main piston chamber in a main piston housing, each main piston having main a piston body with a central hollow member extending down within the main piston body, each of the first pump and the second pump having a compensation member connected to a main piston housing, the compensation member extendable into the central hollow member of the main piston body, the compensation member having a flow channel therethrough from top to bottom, said flow channel in fluid communication with a channel providing fluid under pressure from a surface fluid system, the method further including introducing fluid under pressure into the central hollow member of the main piston body through the flow channel of the compensation member to maintain a pressure within the main piston housing less than a pressure of fluid exterior to the pump; wherein force of said fluid under pressure flowed in the central hollow member of the main piston facilitates downward movement of the main piston, the method further including facilitating downward movement of the main piston with the force of fluid introduced into the central hollow member of the main piston and which flows therefrom into the main piston housing; wherein each of the first pump and the second pump includes a corresponding pump housing which receives recovered power fluid to be pumped to the surface, the method further including each of the first pump and the second pump commencing pumping recovered power fluid to the fluid container only upon complete filling of it corresponding pump housing with recovered power fluid; and/or while the first pump is pumping recovered power fluid to the fluid container, providing recovered power fluid to the second pump for the second pump, in turn, to pump to the fluid container.

The present invention, therefore, provides in at least certain embodiments, a method for recovering power fluid used to power a device under water and for pumping the recovered power fluid to a fluid container above a surface of the water, the method including: flowing fluid from a subsurface apparatus to a subsurface recovery system, the fluid initially provided to the subsurface apparatus to power the subsurface apparatus; and the subsurface recovery system including a pump system for selectively pumping recovered power fluid to a fluid container above a surface of the water, the pump system including a first pump, a second pump, and a valve system, the valve system controlling the first pump and the second pump to allow only one pump of the first pump and the second pump to pump recovered power fluid to the fluid container above the surface of the water, the method further including pumping recovered power fluid to the fluid container with only one pump at a time of the first pump and the second pump, wherein the pump system includes pilot signal apparatus for supplying a pilot signal to the first pump and to the second pump signalling when one of the first pump and the second pump is pumping recovered power fluid to the fluid container so that the pump receiving said pilot signal is then prevented from pumping recovered power fluid to the fluid container, the method further including sending said pilot signal to one of the first pump or the second pump and then preventing said pump receiving said pilot signal from pumping recovered power fluid to the fluid container, continuously pumping recovered power fluid to the fluid container with the pump system using alternately the first pump then the second pump, and while the first pump is pumping recovered power fluid to the fluid container, providing recovered power fluid to the second pump for the second pump, in turn, to pump to the fluid container.

The present invention, therefore, provides in at least certain embodiments, a system for recovering power fluid used to power a device under water and for pumping the recovered power fluid to a fluid container above a surface of the water, the system including: subsurface recovery system for receiving power fluid exhausted subsurface from a subsurface apparatus, the power fluid initially provided to the subsurface apparatus to power the subsurface apparatus; a pump system for selectively pumping recovered power fluid to a fluid container above a surface of the water, the pump system including at least one pump for pumping recovered power fluid to the fluid container, a valve system, and the valve system for controlling the at least one pump. Such a system may have one or some, in any possible combination, of the following: wherein the at least one pump is a first pump and a second pump, the valve system for controlling the first pump and the second pump to allow only one pump at a time of the first pump and the second pump to pump recovered power fluid to the fluid container above the surface of the water; the pump system including pilot signal apparatus for supplying a pilot signal to the first pump and to the second pump signalling when one of the first pump and the second pump is pumping recovered power fluid to the fluid container so that the pump receiving said pilot signal is then prevented from pumping recovered power fluid to the fluid container; the pump system for continuously pumping recovered power fluid to the fluid container; wherein a definite amount of power fluid powers the subsurface apparatus, the system further including the pump system including shut off apparatus for automatically shutting off the pump system when the definite amount of power fluid has been pumped by the pump system to the fluid container; wherein each of the first pump and the second pump has a main piston and an associated mechanically-activated valve actuatable by contact by a corresponding main piston so that moving a main piston of the first pump or of the second pump to contact a corresponding mechanically-activated valve to close said valve allows said main piston to move down so that a chamber in which said piston is movable can fill with recovered power fluid to be pumped to the fluid container; wherein each main piston of the first pump and the second pump has an activation member connected thereto for contacting a corresponding mechanically-activated valve and said activation member is spring loaded with a spring device to provide snap action for facilitating contact with and actuation of the mechanically-activated valve; wherein the at least one pump has a main piston movably disposed in a main piston chamber in a main piston housing, the main piston housing having a flow channel therethrough in fluid communication with the main piston chamber for providing fluid under pressure from a surface fluid system above the main piston so that introducing fluid under pressure into the main piston chamber through the flow channel maintains a pressure within the main piston housing less than a pressure of fluid exterior to the at least one pump; wherein each of the first pump and the second pump has a main piston movably disposed in a main piston chamber in a main piston housing, each main piston having a main piston body with a central hollow member extending down within the main piston body, each of the first pump and the second pump having a compensation member connected to a main piston housing, the compensation member extendable into the central hollow member of the main piston body, the compensation member having a flow channel therethrough from top to bottom, said flow channel in fluid communication with a channel providing fluid under pressure from a surface fluid system so that introducing fluid under pressure into the central hollow member of the main piston body through the flow channel of the compensation member maintains a pressure within the main piston housing less than a pressure of water exterior to the pump system; wherein force of said fluid under pressure flowed in the central hollow member of the main piston facilitates downward movement of the main piston; wherein each of the first pump and the second pump includes a corresponding pump housing which receives recovered power fluid to be pumped to the surface, each of the first pump and the second pump controlled so that said pump is able to commence pumping recovered power fluid to the fluid container only upon complete filling of a corresponding pump housing with recovered power fluid; and/or fluid provision apparatus for providing recovered power fluid to the second pump for the second pump while the first pump is pumping recovered power fluid to the fluid container.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification is in accordance with the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. What follows are some of the claims for some of the embodiments and aspects of the present invention, but these claims are not necessarily meant to be a complete listing of nor exhaustive of every possible aspect and embodiment of the invention. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for recovering power fluid used to power a device under water and for pumping the recovered power fluid to a fluid container above a surface of the water, the method comprising:

flowing fluid from a subsurface blowout preventer operator to a subsurface recovery system, the fluid initially provided to the subsurface blowout preventer operator to power the subsurface blowout preventer operator, the subsurface recovery system including a pump system for selectively pumping the recovered power fluid from the blowout preventer operator to the fluid container above the surface of the water, the pump system comprising:

at least one pump for pumping the recovered power fluid from the blowout preventer to the fluid container; and a valve system, the valve system controlling the at least one pump; and pumping the recovered power fluid to the fluid container with the at least one pump.

2. The method of claim 1 wherein the at least one pump has a main piston movably disposed in a main piston chamber in a main piston housing, the main piston housing having a flow channel therethrough in fluid communication with the main piston chamber for providing fluid under pressure from the subsurface recovery system into the main piston housing above the main piston, the method further comprising introducing fluid under pressure into the main piston chamber through the flow channel to maintain a pressure within the main piston housing less than a pressure of fluid exterior to the at least one pump.

3. A method for recovering power fluid used to power a subsurface apparatus under water and for pumping the recovered power fluid to a fluid container above a surface of the water, the method comprising:

providing fluid to the subsurface apparatus to power the subsurface apparatus;

storing fluid exhausted after powering the subsurface apparatus in a subsurface recovery system as the recovered power fluid;

providing the subsurface recovery system with a pump system having a first pump, a second pump, and a valve system, for selectively pumping recovered power fluid to a fluid container above a surface of the water;

pumping the recovered power fluid to the fluid container with one pump of the first pump and the second pump;

controlling the first pump and the second pump by the valve system, to prevent another pump of the first pump and the second pump from pumping the recovered power fluid to the fluid container, when the one pump of the first pump and the second pump is pumping the recovered power fluid to the fluid container;

applying pressure of the recovered power fluid to the other pump to assist its movement; and ceasing the pumping of the recovered power fluid when the subsurface recovery system is exhausted.

4. The method of claim 3 the method further comprising supplying pilot signals by a pilot signal apparatus of the pump system;

wherein said pilot signals prevents the other pump from pumping recovered power fluid to the fluid container, when the one pump is pumping recovered power fluid to the fluid container.

5. The method of claim 3 further comprising continuously pumping recovered power fluid to the fluid container with the pump system using alternately the first pump then the second pump, until the subsurface recovery system is exhausted.

6. The method of claim 3 wherein the recovered power fluid pumped to the fluid container is provided to power the subsurface apparatus.

7. The method of claim 3 further comprising providing each of the first pump and the second pump with a main piston in a corresponding chamber, and with an corresponding mechanically-activated valve actuatable by contact with the corresponding main piston;

moving the main piston of the one pump to contact the corresponding mechanically-actuated valve to shift said corresponding mechanically-actuated valve;

wherein said shifted corresponding mechanically-actuated valve changes the one pump to the other pump, such that said corresponding main piston moves down, to fill the corresponding chamber with recovered power fluid.

8. The method of claim 7 further comprising connecting each main piston with a spring loaded activation member; and actuating the mechanically-activated valves by the corresponding spring loaded activation member with a snap action.

9. The method of claim 3 further comprising providing each of the first pump and the second pump with a main piston movably disposed in a corresponding main piston chamber, in a main piston housing;

extending a corresponding central hollow member down within a corresponding piston body of each main piston extending a corresponding compensation member having a flow channel therethrough from top to bottom into the corresponding central hollow member of each main piston body;

providing fluid under pressure from a surface fluid system through a separate channel to the flow channels; and introducing fluid under pressure into each central hollow member of each main piston body through the corresponding flow channel.

10. The method of claim 9 wherein the method further comprising facilitating downward movement of the main piston with the pressure of fluid introduced into the central hollow member of the main piston.

11. The method of claim 10 wherein each of the main piston chambers defines a corresponding pump chamber which receives recovered power fluid to be pumped to the surface, wherein each of the first pump and the second pump does not pump recovered power fluid to the fluid container until after complete filling of its corresponding pump chamber with recovered power fluid.

12. The method of claim 3 further comprising providing recovered power fluid to the second pump while the first pump is pumping recovered power fluid to the fluid container.

13. A method for recovering power fluid used to power a subsurface apparatus under water and for pumping the recovered power fluid to a fluid container above a surface of the water, the method comprising:

providing fluid to the subsurface apparatus to power the subsurface apparatus;

storing fluid from the subsurface apparatus in a subsurface recovery system as the recovered power fluid;

providing the subsurface recovery system with a pump system having a first pump, a second pump, and a valve system for selectively pumping recovered power fluid to a fluid container above a surface of the water;

pumping recovered power fluid to the fluid container with one pump of the first pump and the second pump;

supplying pilot signals by a pilot signal apparatus of the pump system;

wherein said pilot signals prevents another pump from pumping recovered power fluid to the fluid container, when the one pump is pumping recovered power fluid to the fluid container;

providing recovered power fluid to the other pump while the one pump is pumping recovered power fluid to the fluid container;

applying a compensated pressure to the first and second pumps to assist their movement; and continuously pumping recovered power fluid to the fluid container with the pump system using alternately the first pump then the second pump, until the subsurface recovery system is exhausted.

14. A system for recovering power fluid used to power a device under water and for pumping the recovered power fluid to a fluid container above a surface of the water, the system comprising:

a subsurface recovery system for receiving power fluid exhausted subsurface from a subsurface blowout preventer operator, the power fluid initially provided to the subsurface blowout preventer operator to power the subsurface blowout preventer operator; and a pump system for pumping the recovered power fluid to the fluid container above the surface of the water, the pump system comprising:

at least one pump for pumping the recovered power fluid from the blowout preventer to the fluid container; and a valve system for controlling the at least one pump.

15. The system of claim 14, wherein the at least one pump comprises a first pump and a second pump, the valve system for controlling the first pump and the second pump to allow only one pump at a time of the first pump and the second pump to pump the recovered power fluid to the fluid container above the surface of the water.

16. The system of claim 15, wherein the pump system includes a pilot signal apparatus for supplying a pilot signal to the first pump and to the second pump to signal when one pump of the first pump and the second pump is pumping the recovered power fluid to the fluid container so that another pump of the first and second pump is then prevented from pumping the recovered power fluid to the fluid container.

17. The system of claim 15, wherein the pump system continuously pumps the recovered power fluid to the fluid container until a definite amount of the power fluid from the subsurface recovery system is pumped to the fluid container.

18. The system of claim 15, wherein a definite amount of the power fluid powers the subsurface blowout preventer operator, the system further comprising a shut off apparatus for automatically shutting off the pump system when the definite amount of the power fluid has been pumped by the pump system to the fluid container.

19. The system of claim 15 wherein each of the first pump and the second pump has a main piston and an associated mechanically-activated valve actuatable by contact by the corresponding main piston so that moving the main piston of one of the first pump and the second pump to contact the corresponding mechanically-activated valve to shift, said corresponding mechanically-activated valve allows said main piston to move down so that a chamber in which said piston is movable fills with the recovered power fluid to be pumped to the fluid container.

20. The system of claim 15, wherein each main piston of the first pump and the second pump has an activation member connected thereto for contacting the corresponding mechanically-activated valve and said activation member is spring loaded with a spring device to provide snap action for facilitating contact with and actuation of the corresponding mechanically-activated valve.

21. The system of claim 14 wherein the at least one pump has a main piston movably disposed in a main piston chamber in a main piston housing, the main piston housing having a flow channel therethrough in fluid communication with the main piston chamber for providing fluid under pressure from the subsurface recovery system above the main piston so that introducing fluid under pressure into the main piston chamber through the flow channel maintains a pressure within the main piston housing less than a pressure of fluid exterior to the at least one pump.

22. The system of claim 15 wherein each of the first pump and the second pump has a main piston movably disposed in a main piston chamber in a main piston housing, each main piston having a main piston body with a central hollow member extending down within the main piston body, each of the first pump and the second pump having a compensation member connected to the main piston housing, the compensation member extendable into the central hollow member of the main piston body, the compensation member having a flow channel therethrough from top to bottom, said flow channel in fluid communication with a channel providing fluid under pressure from a surface fluid system so that introducing fluid under pressure into the central hollow member of the main piston body through the flow channel of the compensation member maintains a pressure within the main piston housing less than a pressure of water exterior to the pump system.

23. The system of claim 22 wherein force of said fluid under pressure flowed in the central hollow member of the main piston facilitates downward movement of the main piston.

24. The system of claim 23 wherein each of the first pump and the second pump includes the corresponding pump housing which receives the recovered power fluid to be pumped to the surface, each of the first pump and the second pump controlled so that said each of the first pump and the second pump is able to commence pumping the recovered power fluid to the fluid container only upon complete filling of the corresponding pump housing with the recovered power fluid.

25. The system of claim 15 further comprising a fluid provision apparatus for providing the recovered power fluid to the second pump for the second pump while the first pump is pumping the recovered power fluid to the fluid container.

* * * * *